US006107628A

United States Patent [19]

Smith et al.

[11] Patent Number: 6,107,628

[45] Date of Patent: Aug. 22, 2000

[54] METHOD AND APPARATUS FOR DIRECTING IONS AND OTHER CHARGED PARTICLES GENERATED AT NEAR ATMOSPHERIC PRESSURES INTO A REGION UNDER VACUUM

[75] Inventors: Richard D. Smith, Richland; Scott A. Shaffer, Seattle, both of Wash.

[73] Assignee: Battelle Memorial Institute, Richland, Wash.

[21] Appl. No.: 09/090,896

[22] Filed: Jun. 3, 1998

[51] Int. Cl.[7] ..... H01J 49/42

[52] U.S. Cl. ..... 250/292; 250/396 R

[58] Field of Search ..... 250/292, 291, 250/290, 396 R, 281, 282, 288

[56] References Cited

U.S. PATENT DOCUMENTS

| | | | |
|---|---|---|---|
| 3,501,631 | 3/1970 | Arnold | 250/41.9 |
| 3,560,734 | 2/1971 | Barnett et al. | 250/41.9 |
| 3,683,194 | 8/1972 | Levin et al. | 250/213 |
| 3,932,786 | 1/1976 | Campbell | 315/313 |
| 4,209,696 | 6/1980 | Fite | 250/281 |
| 4,531,056 | 7/1985 | Labowsky et al. | 250/288 |
| 4,542,293 | 9/1985 | Fenn et al. | 250/288 |
| 4,667,111 | 5/1987 | Glavish et al. | 250/492.2 |
| 5,120,958 | 6/1992 | Davis | 250/292 |
| 5,130,538 | 7/1992 | Fenn et al. | 250/282 |
| 5,179,278 | 1/1993 | Douglas | 250/290 |
| 5,206,506 | 4/1993 | Kirchner | 250/281 |
| 5,397,959 | 3/1995 | Takahashi et al. | 315/314 |
| 5,572,035 | 11/1996 | Franzen | 250/396 |
| 5,811,800 | 9/1998 | Franzen et al. | 250/292 |
| 5,818,055 | 10/1998 | Franzen | 250/292 |

FOREIGN PATENT DOCUMENTS

| | | |
|---|---|---|
| 0027037 | 4/1981 | European Pat. Off. . |
| 0283941 | 9/1988 | European Pat. Off. . |
| 0369101 | 5/1990 | European Pat. Off. . |
| 0513909 | 11/1992 | European Pat. Off. . |
| 7-22617 | 8/1995 | Japan . |

OTHER PUBLICATIONS

DJ Douglas, JB French, Collisional Focusing Effect in Radio Frequency Quarupoles, J Am Soc Mass Spectrom 1992, 3, 398–408.

D Gerlich, Inhomogeneous RF Fields: A Versatile Tool for the Study of Processes With Slow Ions, 1992 John Wiley & Sons, Inc.

*Primary Examiner*—Kiet T. Nguyen
*Attorney, Agent, or Firm*—Stephen R. May

[57] ABSTRACT

A method and apparatus for focusing dispersed charged particles. More specifically, a series of elements within a region maintained at a pressure between $10^{-1}$ millibar and 1 bar, each having successively larger apertures forming an ion funnel, wherein RF voltages are applied to the elements so that the RF voltage on any element has phase, amplitude and frequency necessary to define a confinement zone for charged particles of appropriate charge and mass in the interior of the ion funnel, wherein the confinement zone has an acceptance region and an emmitance region and where the acceptance region area is larger than the emmitance region area.

23 Claims, 12 Drawing Sheets

100
21+
24+
19+
13+
1.23 x 10^6
68 V 100
18+
16+
21+
15+
13+
3.55 x 10^6
98 V 100
17+
14+
18+
13+
2.79 x 10^6
130 V 100
15+
12+
11+
1.40 x 10^6
158 V 100
12+
10+
9+
3.65 x 10^5
185 V 100
11+
9+
8+
3.03 x 10^5
220 V 100
9+
7+
8.64 x 10^4
260 V 100
8+
6+
1.73 x 10^4
308 V
500
1000
1500
2000
2000
3000
m/z

METHOD AND APPARATUS FOR DIRECTING IONS AND OTHER CHARGED PARTICLES GENERATED AT NEAR ATMOSPHERIC PRESSURES INTO A REGION UNDER VACUUM

This invention was made with Government support under Contract DE-AC06-76RLO 1830 awarded by the U.S. Department of Energy. The Government has certain rights in the invention.

FIELD OF THE INVENTION

The present invention relates generally to a method and apparatus for directing or focusing dispersed charged particles into a variety of analytical apparatus in the presence of a gas. More specifically, the invention allows a dispersion of charged particles generated at or near atmospheric pressure to be effectively transferred into a region under vacuum.

BACKGROUND OF THE INVENTION

A great variety of scientific inquiry is confronted with the challenge of identifying the structure or composition of particular substances. To assist in this identification, a variety of schemes have arisen which require the ionization of the particular substance of interest. This need spans all charged particles including subatomic particles, small ions, and charged particles and droplets exceeding a micron in diameter.

In many such ion generating schemes, the presence of a gas or air is either essential to the ionization process or is an unavoidable consequence of the process. For example, in some cases, the ion current is measured, generally as a function of time, to assist in the identification, as in ion mobility analysis, or with thermal, flame or photoionization detectors used in conjunction with gas chromatography separations.

Charged particles beams are also used in ion guns, ion implanters, laser ablation plumes, and various mass spectrometers (MS), including quadrupole MS, time of flight MS, ion trap MS, ion cyclotron resonance MS, and magnetic sector MS. In mass spectrometry applications, typical arrangements often combine the charged particles or analyte with a carrier gas in an electrical field, whereupon particles are ionized by one method or another (e.g., inductive charging of particles) for use in an analytical process.

Many of these analytical techniques, as well as the other industrial uses of charged particles, are carried out under conditions of high vacuum. However, many ion sources, particularly sources used in MS and other analytical applications, operate at or near atmospheric pressures. Thus, those skilled in the art are continually confronted with challenges associated with transporting ions and other charged particles generated at atmospheric or near atmospheric pressures, and in many cases contained within a large gas flow, into regions maintained under high vacuum.

An illustrative example of this general problem is presented in the use of mass spectrometry as an analytical technique. In many applications of mass spectrometry, a charged particle or ion beam is generated at a higher pressure, for example, approximately atmospheric pressure in the case of electrospray ionization, and is then passed to a region maintained at a much lower pressure where the mass spectrometer can function effectively. In such an arrangement, the charged particle beam is directed through at least one small aperture, typically less than 1 mm diameter, which is used to maintain the pressure differential.

Several stages of differential pumping are often used to create large pressure differences, and thus each of the regions are connected in series through apertures in order to allow gas flow into the lower pressure region.

Because of the dispersion of the charged particle beam, and the limited cross section defined by the aperture, a significant portion of the beam is typically unable to pass through each aperture and is thus lost. In many applications, a portion of the beam which is lost includes ions of interest, and may thus result in a decrease in the sensitivity of the analytical device. This can serve to preclude many analytical applications. Also, a loss of a portion of the beam may result in a disproportionate loss of the ions of analyte because the ions of analyte may not be evenly distributed throughout the charged particle beam.

In other uses of charged particles, it may be desirable to direct or collect dispersed charged particles which have not been generated as part of an charged particle beam per se. For example, in an atmospheric charged particle sampling device, it may be desirable to sample a large volume of air for the presence of some charged particles of interest. These charged particles may be ambient, or produced by photoionization or other means. It would be useful to have a means by which charged particles in the air are captured and directed to a detector, collector or other devices. Examples of possible uses include environmental monitoring for releases of ambient ions, aerosols, and other ion-producing processes such as combustion.

To assist in the transfer of ions and other charged particles at lower pressures, the use of DC electrical (electrostatic) fields, generated by a variety of methods, for the manipulation of charged particles or to assist in the collection of charged particles, is well known in the art. In ion sources operated at higher pressures, an unavoidable consequence is the presence of gas phase collisions and charge-charge repulsion interactions that lead to expansion of the ion cloud. Conventional ion optics devices such as electrostatic devices, which can function effectively to focus ions under vacuum conditions, are ineffective for avoiding or reversing the ion cloud expansion brought about by gas phase collisions and the repulsive electrical forces between charged particles. Also, time varying (electrodynamic) or radiofrequency (RF) electric fields can be applied for focusing purposes. An example of such RF devices are RF multipole devices in which an even number of rods or "poles" are evenly spaced about a line that defines the central axis of the multipole device. These include quadrupole, hexapole, octopole and "n-pole" or greater multipole devices that are used for the confinement of charged particles in which the phase of the RF is varied between adjacent poles. The use of these devices can result in focusing of an ion beam due to collisional damping in the presence of a gas as described in U.S. Pat. No. 4,963,736 to D. J. Douglas entitled "Mass Spectrometer and Method with Improved Ion Transmission" and U.S. Pat. No. 5,179,278 to D. J. Douglas entitled "Multipole Inlet System for Ion Traps." It is generally recognized that RF multipole devices can be used to trap or confine charged particles when operated at appropriate RF frequencies and amplitudes. In such arrangements, the motion of charged particles of appropriate mass and charge is constrained by the effective repulsion (of the "pseudo potential") arising from the RF field near the electrodes (poles). The charged particles thus tend to be repulsed from the region near the electrodes and tend to be confined to the inner region which is relatively field free. Thus, for example, in quadrupole devices, which are typically operated in high vacuum, ions tend to oscillate within the area inscribed by the four poles. In multipole devices with larger numbers of poles, the increased number of poles enlarges the region of lower field, or region which is effectively field free. Also known in the art are ring electrode devices wherein the field free region is dictated by the diameter and the spacing between the rings. Ring electrode devices consist of conductive rings having approximately equal spacing between rings, and have confinement properties determined by the diameter of and the ring thickness which roughly corresponds to the properties determined by the rod diameter and spacing in multipole devices. The similar alternating phase of the RF voltages for each subsequent ring of such devices enables their use as "ion guides." Such devices are used far less frequently than conventional multipole ion guides.

Also known in the art are quadrupole mass filters which use DC potentials with quadrupole devices to discriminate ions according to their mass to charge ratio. In the absence of the DC potentials and in the presence of a low pressure gas, these types of ion guides do result in a reduction of the dispersion of the ions due to collisional damping of charged particles to the field free region. At higher pressures however, ion velocities may become too small for ions to rapidly exit the multipole, resulting in a build up of space charge and decreased ion transmission.

The nearly field free region is constant across the length of the multipole or ring electrode device and includes some fraction of the volume inscribed by the poles or rings. Given a fixed number of poles or rings, the nearly field free region may thus only be significantly increased by increasing the distance between the poles or rings and the diameter of the poles or rings, both of which require an increase in the RF voltage applied to the poles or rings to obtain effective confinement. Again, given a fixed number of poles or rings, the size of a cross section of the field free region, and thus the size of the region which accepts ions (or the ion acceptance region), increases as the square root of the RF voltage applied to the poles or rings. Thus, to create any significant gain in the cross section of the field free region, and thus the ion acceptance region, in practice requires prohibitively large RF voltages. Larger acceptance regions can also be obtained by the use of higher multipole devices, but a general failing of this approach is that the nearly field free region becomes correspondingly large and effective focusing to a small region is not obtained. Thus, the ability to focus ions through a small diameter aperture is reduced.

U.S. Pat. No. 5,572,035 to Jochen Franzen, entitled "Method and device for the reflection of charged particles on surfaces", describes a variety of configurations of strong but inhomogeneous RF fields of short space penetration for the reflection of charged particles of both polarities at arbitrarily formed surfaces. As described by the inventor, this device "is particularly useful for the guidance and storage of ions in a pressure regime below about $10^{-1}$ millibar, and with frequencies above 100 kilohertz. It may be used at normal air pressures for charged macroparticles." Thus, as described by the inventor, the invention of the Franzen patent is ill suited for operation at pressures close to atmospheric, where the transition from an ion source to an instrument having a low pressure region would be located, except for macromolecules, and only then through the use of audio frequencies. Such macromolecules, or macroparticles, are many orders of magnitude in both mass or mass to charge rations than analyzed by mass spectrometry.

Thus, there exists a need for a device which can both guide ions and focus a dispersion of charged particles at near atmospheric pressures.

SUMMARY OF THE INVENTION

Accordingly, it is an object of the invention in one of its aspects to provide a method for focusing, and reducing a dispersion of, charged particles in a pressure region at near atmospheric pressures. As used herein, "near atmospheric" pressures are defined as between $10^{-1}$ millibar and 1 bar. As used herein, the charged particles which are to be focused according to the present invention, are defined as being smaller than one billion AMUs. The focusing of the present invention is accomplished by providing an apparatus, hereinafter referred to as an "ion funnel", which is operated at near atmospheric pressures and which generates an RF field having a field free zone with an acceptance region and an emmitance region, where the acceptance region is larger than the emmitance region. The ion funnel has at least two members, each member having an aperture, such that the apertures are disposed about a central axis and define a region of charged particle confinement. The members, by way of example, can be formed as circular rings, wherein the interior diameter of the ring defines the aperture. Some fraction of this interior diameter defines the useful acceptance region of the device. However, the members and the apertures are not limited to circular forms and may take any shape. The first aperture, or entry, of the ion funnel is larger than the second aperture, or exit. A funnel shape is thus created by the boundaries of the apertures, which also defines the side or sides of the ion funnel. The size and shape of the entry and exit apertures, as well as apertures disposed between the entry and the exit, are selected to control the size and shape of a beam or cloud of charged particles (such as ions) directed through the ion funnel. A cross section of the funnel may be any shape, for example, round, square, triangular or irregularly shaped, and the shape of the cross section may vary along the length of the ion funnel. Thus, examples of desired shapes for the apertures of the ion funnel would thus include, but not be limited to, circular, oval, square, trapezoidal, and triangular.

The ion funnel has RF voltages applied to alternating elements such that progressing down the ion funnel, the RF voltages alternate at least once, and preferably several times, so that the RF voltages of adjoining elements are out of phase with adjacent elements. In general, adjacent elements may be out of phase with one and another by between 90 degrees and 270 degrees, and are preferably 180 degrees out of phase with one and another. Thus, an RF field is created with a field free zone in the interior of the ion funnel wherein the field free zone has an acceptance region at the entry of the ion funnel and an emmitance region at the exit of the funnel and the acceptance region is larger than the emmitance region. The RF voltages thus act to constrain charged particles within the field free region, and as charged particles move from the entry to the exit, the field free region decreases in diameter to confine the charged particles into a smaller cross section. Charged particles driven through the ion funnel are thus focused into a charge particle beam at the exit of the ion funnel. Ions so effected can be said to be "trapped" or "directed" by the ion funnel. Also, by varying the shape of the apertures, the shape of the resultant charged particle beam may be varied to correspond to a shape desired by the user.

It is a further object of the invention that the ion funnel be positioned within a chamber where ions generated at atmospheric or near atmospheric pressures are to be introduced into a device having the interior maintained at lower pressures. As such, it is preferred that the chamber containing the ion funnel be maintained at between $10^{-1}$ millibar and 1 bar, and it is especially preferred that the chamber containing the ion funnel be maintained at between 1 and 100 millibar.

It is a further object of the invention in one of its aspects to provide a method for driving charged particles through the ion funnel. This may be accomplished by providing a DC potential gradient across the adjacent elements of the ion funnel in addition to the RF voltages applied to the elements. For example, a resistor chain may be used to effect a gradual change in the DC electric field across the individual elements. Each element thus has a time varying voltage corresponding to the summation of the applied DC and RF potentials. The simultaneous constraining force supplied by the RF currents and driving force supplied by the DC gradient thus acts to drive charged particles through the ion funnel.

Alternatively, or in combination with the DC field, mechanical means may be employed for driving the charged particles through the funnel. For example, methods based on gas dynamics may be applied. In this case a gas flow pressure gradient or partial vacuum at the exit of the ion funnel may be employed to push or draw charged particles through the funnel. Also, a fan may also be employed to blow charged particles into the entry and through the funnel.

The specific configuration of the ion funnel may be easily altered to suit a desired need. For example, in applications for atmospheric monitoring for ambient charged particles, the entry may be made as large as desired, since the frequency and RF voltages necessary for effective operation depend primarily upon the elements thickness and the spacing of the elements, but not the acceptance area. Also, the ion funnel may be configured to trap or direct particles with specific mass to charge (m/z) ratios. For example, all else held constant, thinner elements would trap or direct higher m/z ions or charged particles while thicker elements would trap lower m/z ions or charged particles. Similarly, all else held constant, the use of higher RF frequencies would tend to trap or direct charged particles or ions having smaller m/z ratios. Likewise, all else held constant, the use of larger voltages would tend to trap or direct charged particles or ions having larger m/z ratios. Finally, as described above, the shape of the cross section of the resultant charged particle beam may be controlled by changing the shape of the elements or the apertures in the elements.

It should be noted that the ion funnel herein described may be utilized in a wide variety of settings where it is desired to focus a dispersion of charged particles. For example, the ion funnel utilized in mass spectrometers, such as for combined on-line capillary electrophoresis mass spectrometry, would allow much improved focusing of the ion current and thus greatly enhanced analytical sensitivity. In a typical mass spectrometer, the ion current is directed through a series of chambers which are subjected to pumping to reduce pressure to a level amenable with mass spectromic analysis. The chambers are thus separated by apertures designed to limit gas flow and allow a transition form a region at higher pressure to a region at lower pressure. By positioning the ion funnel adjacent to an ion source at atmospheric pressure, the ion beam may be maintained at near atmospheric pressure, and the incoming ion current is effectively focused into the device, minimizing ion dispersal and thus analyte signal losses. Similarly, in applications where diffuse ion beams are generated by methods such as electrospray, thermospray, and discharge ionization, the ion funnel allows greater ion current, and due to the focusing effect on the ions and resultant decrease in ion dispersion, greater ability to aim or focus the ion beam at a desired target, collection device or detector. Used in conjunction with photo-ionization sources, much greater ion collection efficiency and sensitivity can be obtained since the ionization volume can be made arbitrarily large. Also, the ion funnel may be used to trap charged particles by applying a DC potential to the exit of the ion funnel sufficient to preclude the escape of the charged particles of interest. The ion population could therefore be increased in the ion funnel "trap" to a high level, and the DC potential could be lowered at any time to release the trapped ions in a pulse for introduction to another region. Coordinating the release of the pulse of ions with the opening of mechanical shutter or gate used to block a aperture separating two regions maintained at different pressures by differential pumping, thus allowing significant advantages. For example, because it is only necessary to open the gate or shutter at the precise moment of the release of the trapped ions, a great reduction in the gas load on the pumping system can be achieved. This allows high sensitivity for instruments using only small vacuum pumps. The foregoing is only a single example of a possible use of the ion funnel's capability to trap ions and release ions in a pulsed fashion. Other uses and advantages of trapping ions and releasing ions in a pulsed fashion will be apparent to those skilled in the art, and the use of the present invention should in no way be limited to the example of releasing ions in a pulsed fashion in conjunction with a shutter or gate used to block an aperture separating two regions maintained at different pressures by differential pumping.

The ion funnel also allows the capture of free ions in gaseous atmospheres where no particular ion source is apparent. For example, by forcing air through an ion funnel, ions of interest may be effectively directed towards a detector for atmospheric analysis. As demonstrated by the foregoing, and as will be apparent to those skilled in the art, the ion funnel is useful across a broad range of activities and in a broad range of devices where it is desirable to focus dispersed ions. The present invention should in no way be limited to its incorporation in any particular application, device or embodiment.

When charged particles are driven into the entry and then through the plurality of apertures which make up the ion funnel, the effect of the combined forces and fields is to direct the charged particles through the exit of the ion funnel. In this manner, a dispersion of charged particles is compressed as they pass through the ion funnel, and the charged particles are focused from a dispersion into a compact beam. The charged particles may be driven by either mechanical means, for example a fan, a vacuum, or both, or electrical means, for example by providing a dc potential gradient down the central axis of the ion funnel by providing increasing DC voltages to each of the elements. The final aperture can also be used to define the passage into a region of lower pressure, as in a mass spectrometer vacuum system incorporating multiple regions of differential pumping. Alternatively, the final element may be positioned immediately adjacent to such an aperture. In either case concerns about focusing, space charge, differential pumping, and possible electrical discharges, familiar art to those who work in this field, must be considered in the design of any specific implementation. It must also be recognized that it is possible to use multiple ion funnels in series. One case where this is particularly attractive is in regions of different pressure so that ions can be effective transferred through multiple aperture with minimal losses. It should also be recognized that the optimum RF and DC electric fields may be significantly different for such multiple funnel devices; one reason for this would be differences in pressure that would alter the effect of the gas collisions.

In a preferred embodiment of the present invention, a multipole lens element, (i.e. quadrupole, hexapole, octapole), but preferrably a short 0.5–5 cm quadrupole lens element, is located immediately following the exit (i.e. the last electrode) of an ion funnel, resulting in better focusing at high relative pressure (i.e. 0.1–50 Torr) before efficient transmission to an intermediate pressure region (i.e. <about 0.1 to 1 Torr) via a conductance limit (i.e. an orifice electrode).

In another preferred embodiment, the front end of an ion funnel interface is coupled to a multi-inlet system, such as a multi-channel heated capillary inlet system, to improve the number of ions entering the mass analyzer. As will be apparent to those having skill in the art, a multi-inlet system is any system with more than one source wherein ions are introduced into the ion funnel. An example of such multi-inlet system is one which would employ several capillaries, each suitable for introducing ions to the ion funnel. These inlets can be used to monitor different fractions of a chemical process, different chemical processes, or simply to monitor one process with greater sensitivity. Multiple inlets may also be used for different samples from microfabricated devices, as the same concepts would also apply in the case of simply splitting a sample stream to form an array of liquid streams, each of which can produce an electrospray and each having a separate inlet. The advantage obtained from this approach is that the maximum possible ion current goes up linearly with the number of electrosprays. The ion funnel allows the ions from the separate inlets to be recombined and focused to a common axialized ion beam. This embodiment is particularly useful where liquid streams exceed the flow rate for which optimum ionization efficiency is achieved with electrosprays, and thus allows larger ion currents and sensitivity to be obtained in important uses involving, for example, the combination of liquid chromatography with mass spectrometry.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 12A is a plot of RF amplitude versus m/z for maximum charge state intensities from a 29 M horse heart myoglobin solution using the third prototype of the present invention.

DESCRIPTION OF THE PREFERRED EMBODIMENT(S)

Figure 1:
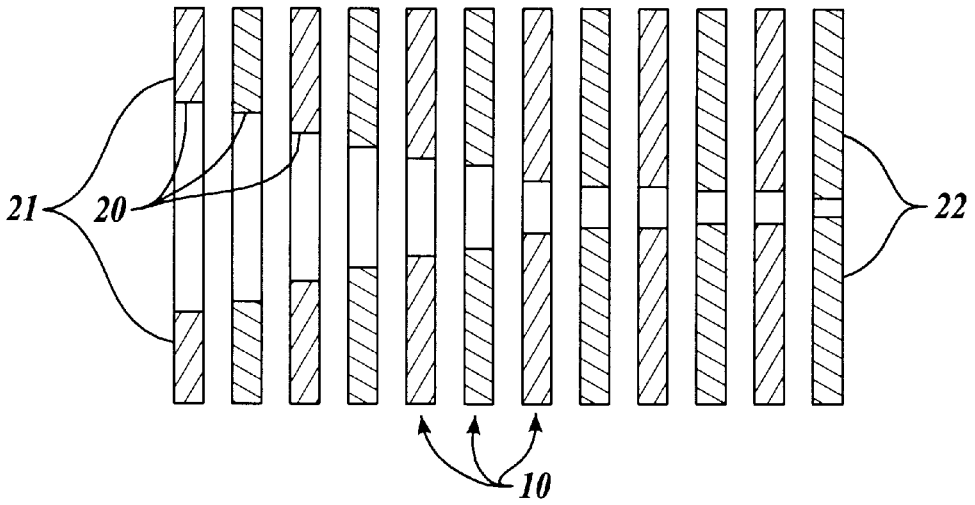
FIG. 1 is a cross section of a first preferred embodiment the present invention.

In a first preferred embodiment of the present invention, as illustrated in FIG. 1, a plurality of elements or rings 10 are provided, each element having an aperture, defined by the ring inner surface 20. At some location in the series of elements, each adjacent aperture has a smaller diameter than the previous aperture, the aggregate of the apertures thus forming a "funnel" shape, or an ion funnel. The ion funnel thus has an entry, corresponding with the largest aperture 21, and an exit, corresponding with the smallest aperture 22. The elements 10 containing the apertures 20 may be formed of any sufficiently conducting material, preferably, the apertures are formed as a series of conducting rings, each ring having an aperture smaller than the aperture of the previous ring. An RF voltage is applied to each of the successive elements so that the RF voltages of each successive element is 180 degrees out of phase with the adjacent element(s), although other relationships for the applied RF field would likely be appropriate. Under this embodiment, a DC electrical field is created using a power supply and a resistor chain to supply the desired and sufficient voltage to each element to create the desired net motion of ions down the funnel.

Figure 2:
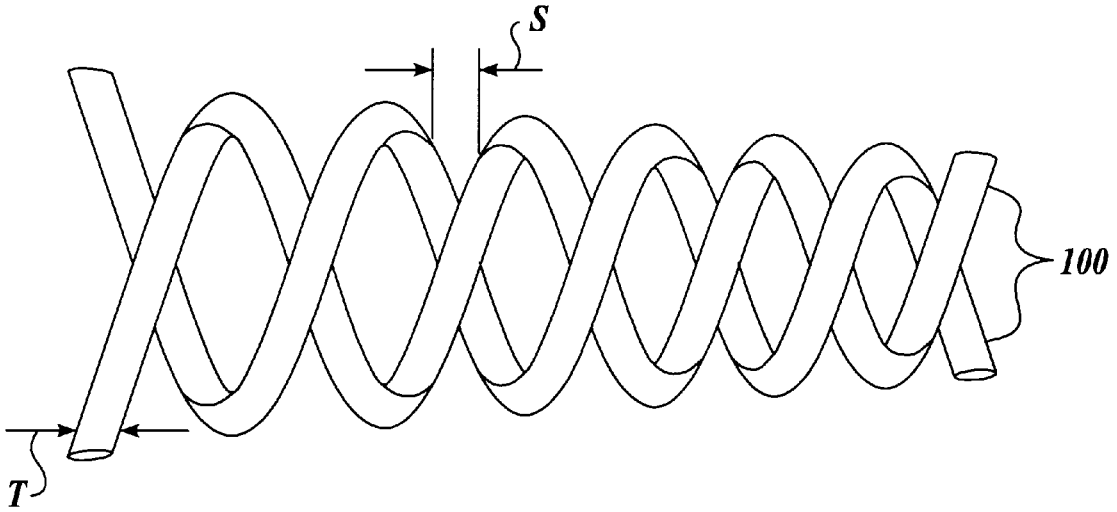
FIG. 2 is an isometric view of a second preferred embodiment the present invention.

In a second preferred embodiment, as illustrated in FIG. 2, the ion funnel may be formed of two conducting conical coils 100 which are fashioned to lie in a helix with one beside the other. The illustration of FIG. 2 is drawn to illustrate the relative positions of conical coils 100; in a preferred embodiment the spacing S between the conical coils is approximately equal to the thickness T of the individual coils. The widest end of the coils form the entry of the ion funnel, and the narrow end of the coils forms the exit of the ion funnel. Such an arrangement allows the alternating successive rings to be substituted with the two element coils, while still allowing each coil element to alternate RF phase with the adjacent coil element. Wide variations in geometry or shape of the device are feasible, the important feature being the difference in RF phase for the adjacent elements that serves to create a confinement. A DC field to drive charged particles through the device may be created by the use of resistive materials, thus creating an actual DC voltage drop across the length of each element. Alternatively, as in the first preferred embodiment, the DC field may be eliminated or used in combination with a driving force created by mechanical means (e.g., hydrodynamics associated with gas flow). In this manner, dispersed charged particles may be propelled through the device to achieve the desired reshaping or compression of the charged particle distribution.

EXAMPLE 1

A prototype ion funnel was built to demonstrate the principle of the invention. In this prototype, four triangles were cut from nonconducting circuit board material and placed edge to edge to form a four-sided pyramid with a square aperture forming the base, or entry. The pyramid was 2½" across at the base, or entry, and had a ⅛" aperture at the top, or exit. Approximately 100 conductive copper strips 0.5 mm in diameter were formed into a series of squares with decreasing size and adhered to the interior walls of the pyramid to form the ion funnel. RF voltages were applied to each of the copper strips such that the RF voltage on each strip was 180 degrees out of phase with the RF voltage applied to the adjoining strip(s). A driving force was generated by applying an increasing DC voltage to each of the successive strips. The largest strip at the base or entry was given a DC potential of about 900 volts and each successive strip was given a voltage of 8.5 V less so that the smallest strip at the top or exit was given a DC potential of about 50 volts. Charged particles generated at atmospheric pressure by a corona discharge were then directed at the entry of the ion funnel. A pico ammeter was then used to detect charged particles at the exit. The first prototype was tested at RF frequencies between about 100 kHz and 1 MHz. Currents ranging from 0 to about 2 nAmp were detected indicating the flow of charged particles through the ion funnel with an efficiency depending upon the RF amplitude and DC potential.

EXAMPLE 2

Figure 3:
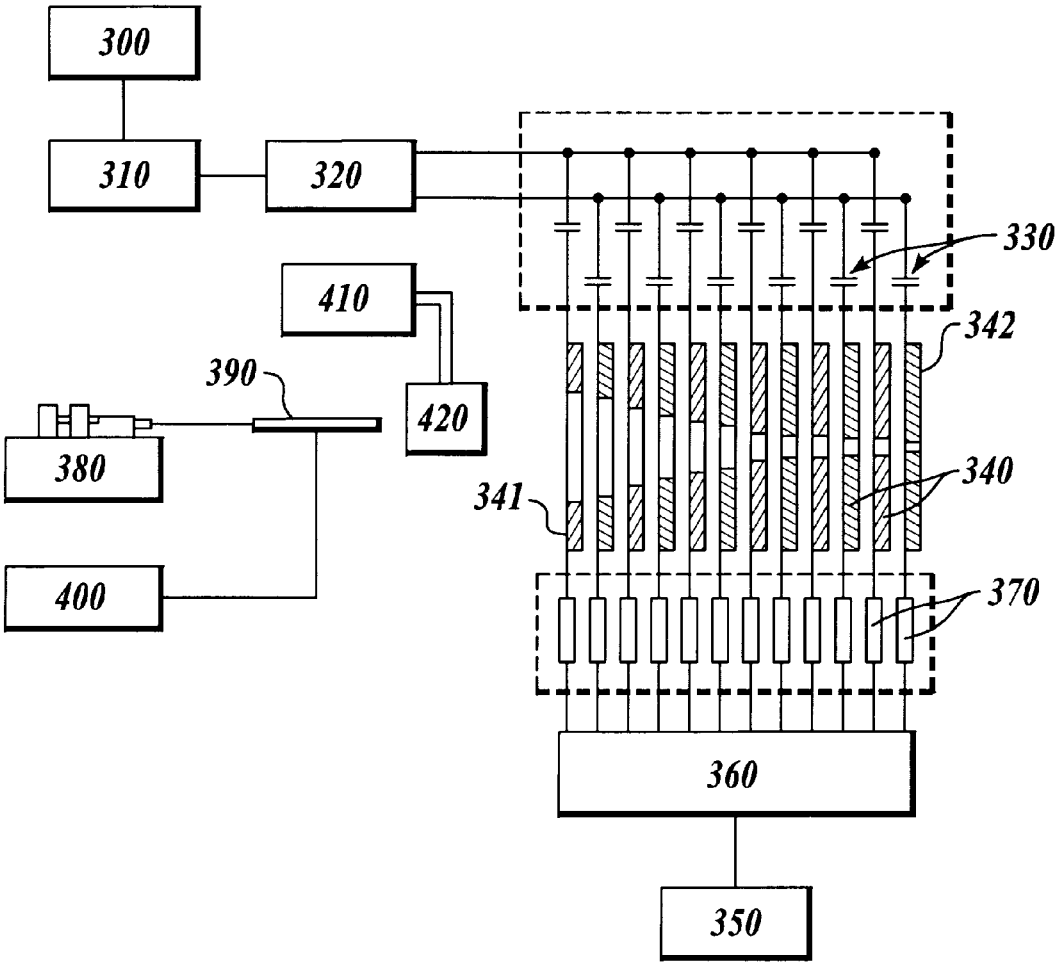
FIG. 3 is schematic drawing of a first prototype of the present invention.

As illustrated in FIG. 3, a second prototype ion funnel was built. A series of 12 stainless steel elements each 1/16" in thickness were placed parallel to one and another to form a second prototype ion funnel. Circular apertures of increasing diameters, ranging from about 1 mm at the exit of the ion funnel to about 25 mm at the entry of the ion funnel, had been cut in the elements. As shown in FIG. 3, an RF voltage was first generated in a signal generator 300 and then amplified with an amplifier 310. The amplified signal was then matched and balanced with a RF High Q Head 320. A series of capacitors 330 were then used to apply the RF signal applied to each of the elements 340 which were 180 degrees out of phase with the RF signal applied to adjacent elements. Simultaneously, a DC voltage supply 350 provided a DC voltage to a voltage divider 360 which then fed the voltage to a series of resistors 370, which in turn fed the voltage to the elements 340. In this manner, DC voltage was varied across the elements with a DC voltage of about 500 to 800 V at the element 341 at the entry of the funnel and a DC voltage of about 100 to 200 V at the element 342 at the exit of the funnel. A syringe pump 380 feeding a solution of cytochrome from a capillary 390 charged with a DC high voltage supply 400 was utilized to provide an ion stream from an electrospraying of the solution as would generally be necessary to form small ions from the charged droplets initially created by the electrospray. A heating power supply 410 also fed a heating mechanism 420 to heat the capillary. In this manner, droplets produced at the capillary tip having a very high mass to charge ratio were evaporated or dissociated into charged particles having smaller mass to charge ratios. The heating step tends to increase the expansion of the resultant ion cloud volume, but the smaller mass to charge particles that result were more effectively directed by the fields generated in the ion funnel. Again, the resultant ion current was measured at the ion funnel exit using a picoammeter.

Figure 4:
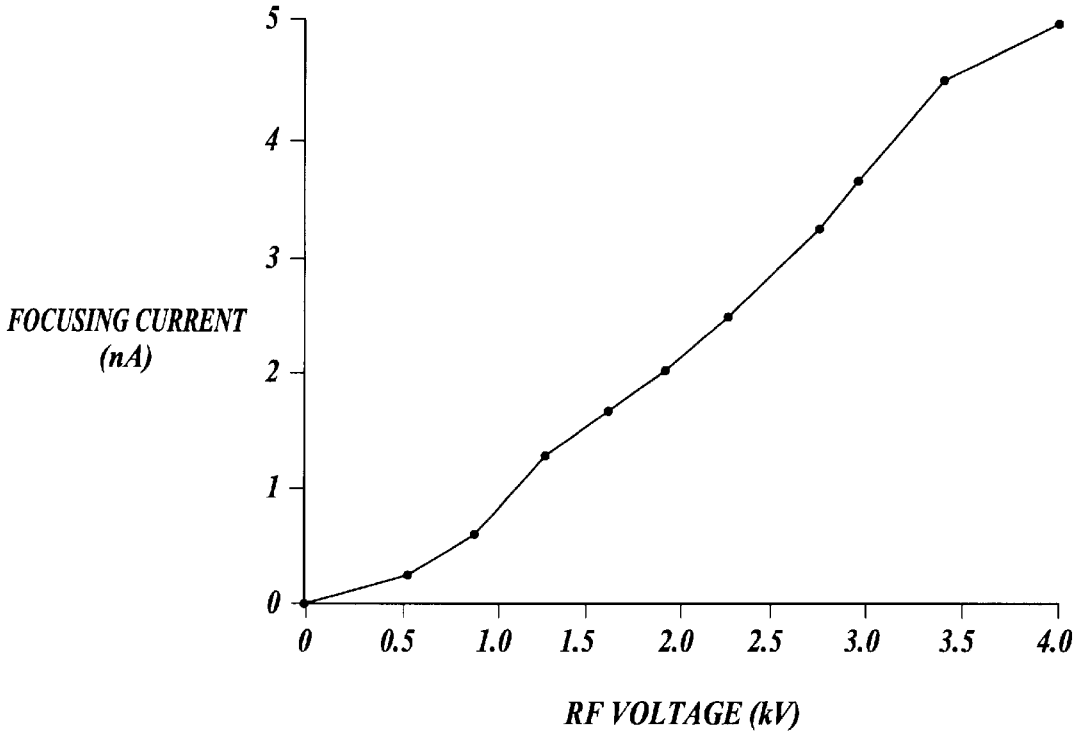
FIG. 4 is a graph of the measured ion current in nanoampres at atmospheric pressure as a function of the applied RF in kV in the second prototype of the present invention.

FIG. 4 shows the measured ion current in nanoampres at atmospheric pressure as a function of the applied RF in kV in the apparatus of the second prototype. The discharge capillary was charged at about 3.09 kV, and the DC voltage was varied across the elements from about 100 V to about 500 V, as indicated in FIG. 4. The RF frequency was applied at about 950 kHz. By comparing the measured ion current at 0 RF amplitude, and at the greatest RF amplitude, it can be seen that the second prototype of the ion funnel thus produced an ion current measured at about 100 times the ion current produced without the ion funnel.

EXAMPLE 3

In a series of experiments designed to improve upon the already impressive sensitivity achievable with electrospray ionization sources, a third prototype of the ion funnel was implemented with a triple quadrupole mass spectrometer. In these experiments, the ion funnel interface effectively consisted of a series of ring electrodes of increasingly small internal diameters to which RF and DC electric potentials were co-applied. In the 1–10 Torr pressure range, the electric fields caused collisionally damped ions to be more effectively focused and transmitted as a collimated ion beam. The performance of this ion funnel design was evaluated using a triple quadrupole mass spectrometer. Ion transmission and m/z discriminating parameters were evaluated based upon ion current measurements and mass spectra. Electrospray ionization mass spectra of selected protein solutions demonstrated well over an order of magnitude increase in signal relative to that of the instrument operated in its standard (capillary inlet-skimmer) configuration under similar conditions. These results suggest that it will be feasible to realize close to 100% ion transmission efficiency through the electrospray ionization interface.

A crucial attribute of the ion funnel in these experiments is that the ion acceptance characteristics of the device are effectively decoupled from the ion emmitance, and arbitrarily large ion clouds can in principal be effectively focused and the coulombically driven ion cloud expansion can be reversed. Thus, a diffuse ion cloud (i.e. from a plume of expanding gas and ions exiting from a heated capillary inlet into the first differentially pumped region of a mass spectrometer following electrospray ionization) can be focused and transmitted to a relatively small exit aperture. The small exit aperture is compatible with the acceptance aperture of an RF multipole, which, when operated at lower pressure in an adjacent differentially pumped region, can the provide efficient ion transport to the mass analyzer. In these experiments, the ion current measurements and mass spectra obtained by interfacing such a prototype to a commercial triple quadrupole mass spectrometer unambiguously support the ion funnel concept and indicate the basis for obtaining significant improvement in the already impressive sensitivity obtainable with ESI-MS.

These experiments were performed using a Finnigan TSQ 7000 triple quadrupole mass (Finnigan MAT, San Jose, Calif., USA) either modified with an ion funnel interface or using the standard ESI ion source, as indicated.

Figure 5:
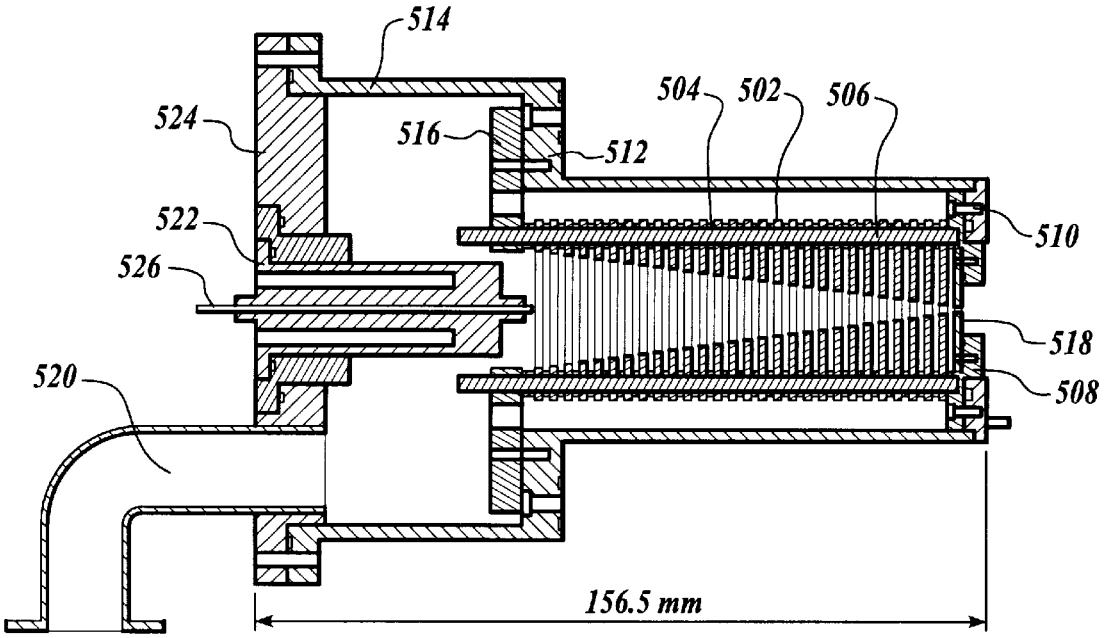
FIG. 5 is a schematic view of the third prototype of the present invention.

The third prototype ion funnel design, as depicted in FIG. 5, consisted of a twenty eight element stack of 1.59 mm thick nickel coated brass ring electrodes 502 (38 mm o.d.) that begins with an initial i.d. of 22.15 mm and decreases parabolically to a final electrode i.d. of 1.00 mm. The inner dimensions of all the electrodes are listed in Table 1.

TABLE 1

Ion Funnel Electrode Inner Diameters.

| Electrode No. | I. D. (mm) |
|---|---|
| 1 | 22.15 |
| 2 | 20.61 |
| 3 | 19.13 |
| 4 | 17.71 |
| 5 | 16.34 |
| 6 | 15.04 |
| 7 | 13.79 |
| 8 | 12.60 |
| 9 | 11.47 |
| 10 | 10.40 |
| 11 | 9.38 |
| 12 | 8.42 |
| 13 | 7.52 |
| 14 | 6.68 |
| 15 | 5.90 |
| 16 | 5.17 |
| 17 | 4.51 |
| 18 | 3.90 |
| 19 | 3.35 |
| 20 | 2.85 |
| 21 | 2.42 |
| 22 | 2.04 |
| 23 | 1.72 |
| 24 | 1.46 |

TABLE 1-continued

Ion Funnel Electrode Inner Diameters.

| Electrode No. | I. D. (mm) |
|---|---|
| 25 | 1.26 |
| 26 | 1.11 |
| 27 | 1.02 |
| 28 | 1.00 |

The electrodes had a rounded and polished inner surface and were equally spaced from each other using 1.59 mm thick ceramic insulating washers 504. The electrodes 502 and washers 504 were mounted on four 107 mm long (3.18 mm diameter) ceramic rods 506 using four tapped holes (equally spaced on d=31.75 mm) on each electrode. Additionally, each electrode had four slots (8.9 mm wide, 5.1 mm deep, all equally spaced) to facilitate connection of electrical components in the relatively tight enclosure of the vacuum housing. The entire electrode assembly was mounted on a PEEK (polyetheretherketone) ring 516 (86.1 mm o.d., 25.4 mm i.d., 6.35 mm thick and mounted adjacent to the largest i.d. ion funnel electrode) with 4 holes fitted to the ceramic mounting rods 510, 12 holes (5.1 mm diameter all equally spaced on d=47.0 mm) to facilitate electrical connections, and 6 additional holes 512 to mount the ion funnel (by 4–40 screws) to the inside of the vacuum housing 514. The electrode assembly in turn was mounted onto a final PEEK ring 508 (49.5 mm o.d., 3.8 mm thick) following the final electrode of the ion funnel which had four equally spaced holes (3.18 mm diameter equally spaced on d=31.75 mm) 2.54 mm deep in which the ceramic mounting rods 506 made a "press" fit. The final PEEK ring 508 had a centered 25.4 mm diameter, 3.18 mm deep hole to mount a nickel coated brass final oriface electrode 518 (25.4 mm o.d., 1.0 mm i.d., 1.6 mm thick) by six equally spaced 0–80 screws. The final PEEK ring 508 further extended on its other side an additional 4.6 mm with an o.d. of 30.5 mm and an i.d. of 10.16 mm. This allows a secure fit into the vacuum housing as depicted in FIG. 5.

A voltage divider (not shown) was used to provide a linear DC voltage gradient between the first and twenty fifth electrodes and consisted of one ¼ watt, 22 megaohm (±10%) carbon resistor (Allen-Bradley, Bellevue, Wash., USA) soldered between each adjacent electrode. Additionally, a 22 megaohm resistor was soldered to the first and twenty fifth electrodes through which the initial and final potentials from the DC power supply were connected, respectively. These two leads allowed independent control of the initial and final potentials of the DC gradient. The final three electrodes (i.e. electrodes #26–28) and the final oriface electrode 518 were independently connected without a resistive load to separate outputs of the DC power supply. All DC potentials to the ion funnel originated from a high voltage mainframe DC power supply (Model 1454, LeCroy, Chestnut Ridge, N.Y., USA).

RF voltages of equal amplitude but opposite phase were applied between adjacent electrodes. Capacitors were utilized to decouple the RF and DC power sources. Further, since the capacitance between adjacent electrodes increases as the internal diameter of the electrodes decrease, a large relative value for the capacitors was chosen to avoid a capacitive gradient. The capacitors were attached by soldering one 680 pF ceramic capacitor (3 kV DC maximum; Sprague-Goodman, Westbury, N.Y., USA) to each electrode but alternating the position of attachment to opposite sides of the electrode assembly between adjacent electrodes. By the latter arrangement, a bus bar (tinned copper) was soldered to each of the two rows of capacitors and thus provided the two leads for RF voltage of equal amplitude but opposite phase. Capacitors were pressed tightly into the areas formed by the slots on each electrode and pieces of 0.5 mm thick Teflon sheeting (Laird Plastics, West Palm Beach, Fla., USA) were placed in between the capacitors and the electrodes to prevent electrical discharge.

Figure 6A:
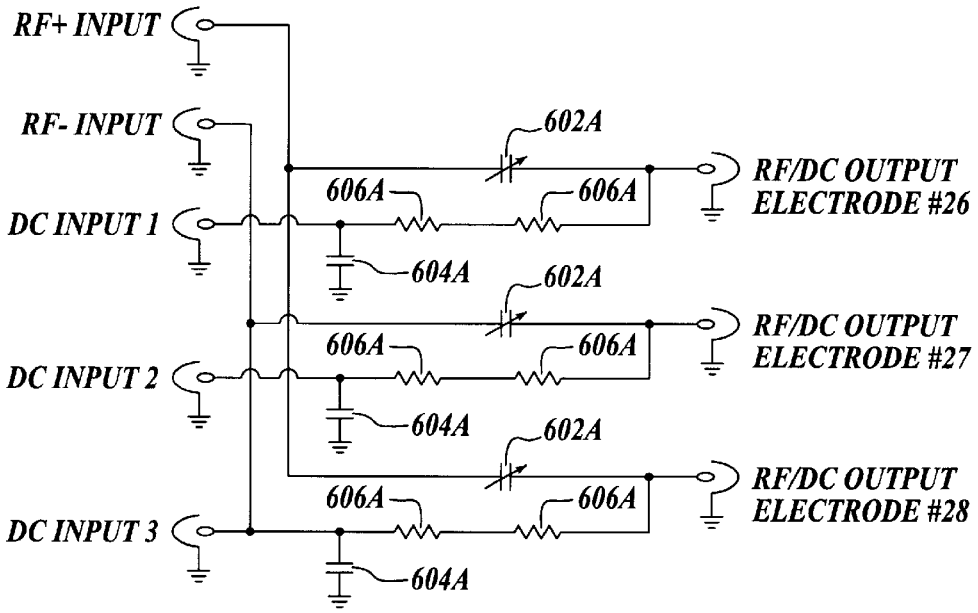
FIG. 6A is a schematic of the RF circuits used in the third prototype of the present invention.

In the cases where a variable RF amplitude was applied on electrodes #26–28 (as compared to the nominal RF amplitude set on electrodes #1–25) the 680 pF capacitors were removed and both the RF and DC potentials were co-applied externally to the ion funnel inside a shielded (aluminum) box (i.e. to prevent RF emissions) using an adjustable RF/DC coupler shown in FIG. 6A. The circuit consists of 3 9–110 pF air variable capacitors 602A (4 kV DC maximum; Surplus Sales of Nebraska, Omaha, Nebr., USA), 3 1 nF ceramic capacitors 604A (3 kV DC maximum; Sprague-Goodman), and 6 2 watt, 10 megaohm carbon resistors 606A (Allen-Bradley). In short, lowering the value of the variable capacitors reduces the RF amplitude on the ion funnel electrodes. High value resistors allow coupling of the RF and DC potentials external to the ion funnel; this coupling was needed only because of a limited number of electric feedthroughs.

Figure 6B:
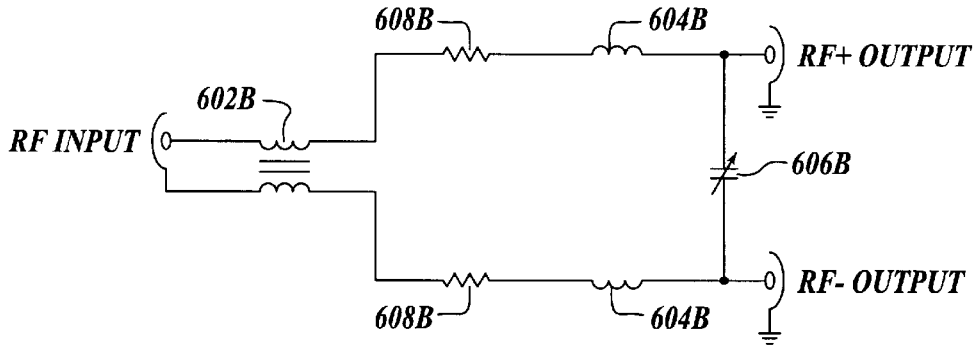
FIG. 6B is a schematic of the high-Q-head used in the third prototype of the present invention.

The RF signal originated from a waveform generator (Model 33120A, Hewlett-Packard, Palo Alto, Calif., USA), was amplified using a 150 watt broadband RF amplifier (Model 2100L, ENI, Rochester, N.Y., USA), and passed through an in-house built high-Q-head shown in FIG. 6B. The high-Q-head converted the unbalanced output from the RF amplifier into a balanced output (i.e. signals of equal amplitude and 180 degrees out of phase with each other) for the ion funnel using a 1:1 impedance balun transformer 602B consisting of a Toroidal type core (Amidon, Santa Ana, Calif., USA) wound with 14 turns of 14 gauge formvar magnet wire with bifilar windings (Amidon). The circuit was housed in a shielded (steel) box and the combination of the 50 H inductors 604B; wound on Toroidal type cores with 31 turns of 14 gauge formvar magnet wire), the 30–300 pF air variable capacitor 606B; Surplus Sales of Nebraska), and the capacitance of the ion funnel, produced a series resonant circuit. The Q or quality factor of the circuit is largely determined by the 50 watt, 25 ohm non-inductive power resistors 608B (Cesiwid, Niagara Falls, N.Y., USA) and was approximately 10 (i.e. output voltage=10×input voltage) when operating at 1 MHz. The variable capacitor served to fine tune the amplitudes of the two RF outputs. The resonant frequency for the ion funnel using the high-Q-head was approximately 700 kHz and was thus the operating frequency for the majority of the work reported in this study. However, when the adjustable RF/DC coupler was employed to lower the RF levels on electrodes #26–28, the resonant frequency shifted to approximately 825 kHz and thus defined the operating frequency used for those studies.

Referring back to FIG. 5, the front flange 524 of the stainless steel vacuum house 514 were fitted with a 18.4 mm inner diameter elbow pumping port 520, a 62.7 mm long aluminum (7000 series) block 522 for heating the capillary inlet 526, 8 welded electric feedthroughs providing RF and DC potentials to the ion funnel (not shown), and 8 clearance holes (equally spaced on d=106.7 mm) to mount the flange 524 to the vacuum housing using 8–32 screws. The front end of the aluminum block was threaded to fit a 76 mm long, 1.6 mm o.d., 0.51 mm i.d. stainless steel capillary 526 (Alltech, Deerfield, Ill., USA) held in place by a Swagelock (Solon, Ohio, USA) fitting. Three 3.2 mm diameter, 41 mm deep holes (equally spaced on d=12.3 mm) were drilled in the front of the aluminum block 522 to house two 3.18 mm diameter stainless steel cartridge heaters (not shown) (100 W, 120 V; Omega, Stamford, Conn., USA) and a Teflon insulated thermocouple wire (not shown) (Type K, Omega). The thermocouple wire was inserted into a hollow ceramic rod (not shown) (3.1 mm o.d., 1.6 mm i.d., 45 mm long) containing vacuum grease (Dow Coming, Midland, Mich.) to make good thermal contact with both the wire and the block 522. The temperature was regulated using a 110 V variable AC transformer (Staco, Dayton, Ohio, USA) coupled to a programmable temperature controller (Model CN 9000A, Omega).

The TSQ 7000's standard (1.0 mm i.d.) skimmer and octapole ion guide (117.5 mm long, 2.0 mm diameter rods equally spaced on d=6.0 mm) were removed and a new octapole, made longer to fill the space created by removing the skimmer, was implemented (139 mm long, same rod size and spacing). In this arrangement, the conduction limit from the first stage pumping to the octapole ion guide was set by the final oriface electrode of the ion funnel. The ion funnel assembly was mounted into the stainless steel vacuum house (lined with 0.5 mm thick Teflon sheeting to prevent electrical discharge) and the assembly fit into a modified ion source block on the TSQ 7000 mass spectrometer. The ion source block needed to be significantly "opened up" to mount the vacuum housing. Two stainless steel (2.4 mm diameter, 6.6 mm long) pegs on the vacuum housing were inserted into holes drilled inside the ion source block fixing the exit to the ion funnel directly in front of the octapole entrance on the mass spectrometer. Additionally, 8 8–32 screws mounted the vacuum housing directly to the source block. Vacuum seals were provided by Viton (DuPont Dow Elastomers, Wilmington, Del., USA) O-rings.

Initial electrospray ion current measurements were measured on the final oriface electrode tightly covered with aluminum foil. The measurements were made at ground potential on the foil using a Keithley (Model 480, Cleveland, Ohio, USA) picoammeter. The ion funnel region was pumped via the pumping port on the front flange of the vacuum housing utilizing a Leybold (Export, Pa., USA) mechanical pump (267 L/min). The pressure was measured by a convection gauge mounted just outside the vacuum housing which read ~1.6 Torr (the actual pressure in the ion funnel due to displacement of the gauge is estimated to be a factor of 2 to 3 higher). The DC gradient on the ion funnel was as follows: initial gradient potential (electrode #1), 300 V; final gradient potential (electrode #25), 100 V; electrode #26, 95 V; electrode #27, 85 V; electrode #28, 50 V. Experiments at increased pressure were achieved by partially closing a block valve (Kurt Lesker, Clairton, Pa., USA) located in between the ion funnel and the first stage mechanical pump.

For the remaining ion current measurements and for the acquisition of mass spectra, the ion funnel utilized a Leybold mechanical pump with a pumping speed of 600 L/min. The other mechanical pump (267 L/min) was connected to the standard pumping port of the TSQ ion source block and pumped the region of the octapole ion guide through two 12 mm diameter wide semi-cylindrical pumping channels cut in the ion source block directly between the vacuum housing and the block. The pumping channels were a non-optimum design which resulted from a previous ion funnel design in which a skimmer was utilized between the funnel and the octapole. With this arrangement, the pressure in the ion funnel was ~1.3 Torr (as read off the ion gauge) and ~2–3×$10^{-3}$ Torr in the mass analyzer chamber. The applied DC potentials for these studies were as follows: initial gradient potential (electrode #1), 225 V; final gradient potential (electrode #25), 80 V; electrode #26, 70 V; electrode #27, 50 V; electrode #28, 25 V; final oriface electrode, 10 V.

The current transmitted to the octapole ion guide was measured by tightly covering the entrance to the octapole with aluminum foil and then measuring the current with a Keithley (Model 617) picoammeter. Ion current entering the mass spectrometer was measured using the picoammeter via a nickel coated brass plate (38 mm o.d.) located approximately 5 mm beyond the exit of the heated capillary inlet.

Electrospray emitter "tips" were made by pulling 0.185 mm o.d., 0.050 mm i.d. fused silica capillary tubing (Polymicro Technologies, Phoenix, Ariz., USA). The electrospray voltage was 2.0 kV and the capillary inlet was biased at 500 volts (ion funnel interface only) using DC power supplies (Models 305 and 303, respectively, Bertan, Hicksville, N.Y., USA). Mass spectra and ion current measurements were obtained at an ESI flow rate of either 200 or 400 nL/min using a Harvard syringe pump (South Natick, Mass., USA). The heated capillary inlet was maintained at a temperature between 170–215° C. The ion funnel was operated at a frequency of 700 kHz or as otherwise indicated.

For comparison, mass spectra were acquired using the standard TSQ 7000 ESI ion source equipped with a 114 mm long and 0.41 mm i.d. heated capillary inlet using similar operating and tuning conditions to that used with the ion funnel. The mass spectra obtained with the standard ESI ion source were measured with three different Finnigan capillary inlets (identical dimensions) for the data presented (e.g. reconstructed ion currents). In either the case of the ion funnel or standard ESI ion source, the mass spectrometer was tuned to maximize ion transmission and obtain identical resolution for selected peaks from a 2.9 M solution of horse heart myoglobin or a mixture containing 2.9 M of horse heart myoglobin and 20.0 M synthetic Phe-Met-Arg-Phe amide, depending on the required mass range. Conditions such as electrospray voltage (2.0 kV), capillary inlet temperature (200 ° C.), electron multiplier voltage (1200 or 1400 V), sample flow rate (200 or 400 nL/min), acquisition scan rate (typically m/z 200–2500 in 3 seconds), and total acquisition time (1 or 2 min. averages) were held constant when directly comparing spectra from the two designs. The ion source block was pumped by an Edwards (Wilmington, Mass., USA) mechanical pump (549 L/min). The pressure measured in ion source block (i.e. between the capillary inlet and the skimmer) was 870–915 mTorr and in the region of the mass analyzer was ~2–4×$10^{-6}$ Torr. All of the data presented was reproduced at least twice.

Myoglobin (horse heart), cytochrome c (horse heart), ubiquitin (bovine red blood cells), gramicidin S (bacillus brevis, hydrochloride salt), Phe-Met-Arg-Phe amide (synthetic), polyethylene glycol (avg. mol. weight, 8000 amu), methanol, and glacial acetic acid were purchased from Sigma (St. Louis, Mo., USA). Standard solutions were prepared in methanol/deionized water/acetic acid (50:50:1%) except for polyethylene glycol which was prepared in methanol/deionized water (50:50). Solutions were kept refrigerated and were prepared from the corresponding standard material biweekly or as needed.

Results and Discussion

The purpose of this embodiment of the ion funnel interface is to realize improved sensitivity by more efficient transmission of the electrospray ion current to the mass analyzer. The ion funnels ability to do this rests upon three aspects of operation: (a) efficient capture of the electrospray ion plume emanating from the heated capillary, (b) effective collisional focusing of the ions in the ion funnel through the use of RF fields and (c) the imposed drift of the ions towards the bottom, or exit, of the funnel due to the DC potential gradient. The observed results, in terms of ion current measurements and mass spectra, supported these basic premises.

Figure 7:
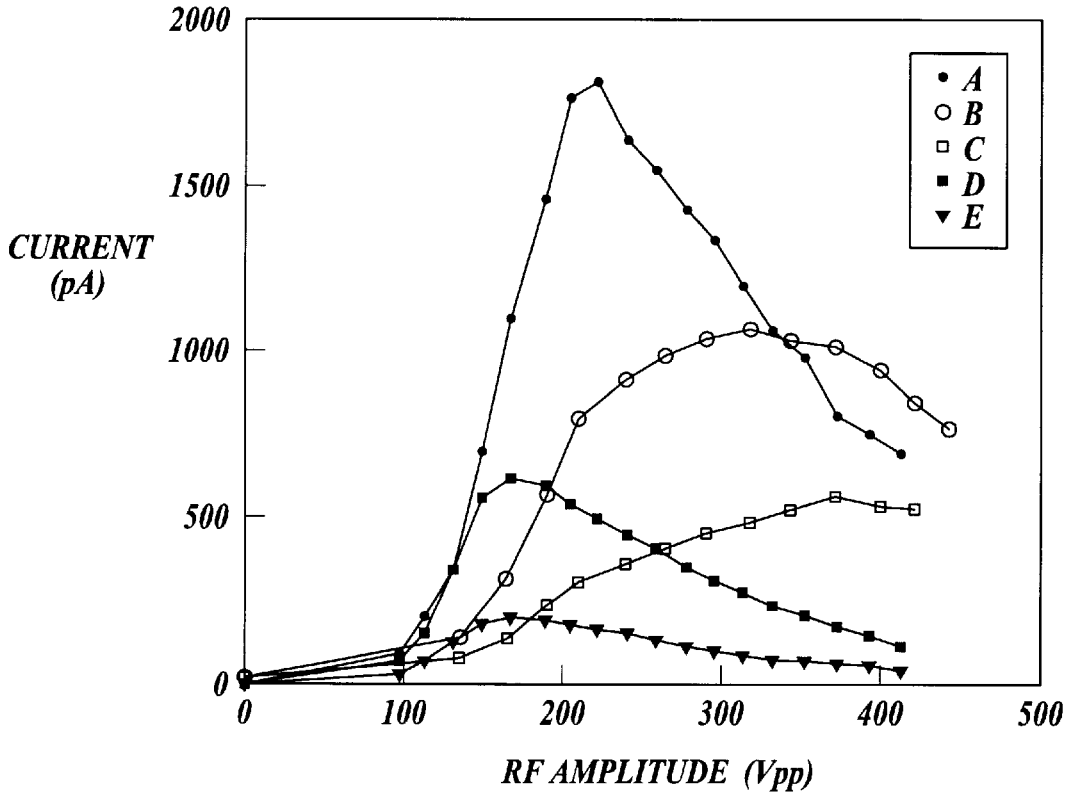
FIG. 7 is a series of graphs showing the ion current measured on the final oriface electrode in the third prototype of the present invention from a bovine ubiquitin solution with the capillary inlet temperature at 170° C. and the following concentration and RF operating conditions: (A) 58 M, 98 $V_{pp}$ RF (700 kHz) on all ion funnel electrodes; (B) 58 M, 98 $V_{pp}$ RF (825 kHz) on electrodes #1–25 and 78 $V_{pp}$ on electrodes #26–28; (C) 58 M, 98 $V_{pp}$ RF 825 kHz) on electrodes #1–25 and electrodes #26–28 operated in the DC-only mode; (D) 5.8 M, 98 $V_{pp}$ RF (700 kHz) on all ion funnel electrodes; (E) 0.58 M, 98 $V_{pp}$ RF (700 kHz) on all ion funnel electrodes.

Ion Current Measurements. Initial experiments involved measuring ESI current collected on a plate at ground immediately following the final electrode of the ion funnel. FIG. 7, data set A, shows a plot of detected current measured for the 100–400 $V_{pp}$ RF amplitude range from ESI of a 58 $\mu$M bovine ubiquitin solution. Beginning at 15 pA, corresponding to DC-only mode of operation, the detected ion current increases as the RF amplitude was increased to a maximum exceeding 1800 pA. This two order of magnitude increase in detected current demonstrates that the presence of RF fields with this device clearly results in improved ion focusing. The effects of RF fields at the bottom of the funnel were explored in particular because it is a region where space-charge and other effects are likely to be most problematic. Using the adjustable RF/DC coupler, the RF amplitude on electrodes #26–28 were reduced relative to the nominal RF amplitude on electrodes #1–25. It is noteable that the change in operation frequency from 700 to 825 kHz reflects the change in resonating frequency of the series circuit (i.e. the adjustable RF/DC circuit, high-Q-head, and ion funnel). An ESI of the same ubiquitin solution and operating at 80% and 0% of the nominal RF amplitude applied to electrodes #1–25 yielded a maximum ion current of 1.1 and 0.5 nA, respectively FIG. 7, data set B and C respectively. The overall shape of these two curves are similar but the overall amount of detected ion current was reduced to less than half by operating ion funnel electrodes #26–28 in the DC-only mode. Interestingly, the shape of the curve at 700 kHz is markedly different and shows a much sharper transmission maximum than the curves taken at 825 kHz. Thus, the data shows that the RF fields clearly mediate the ion current focused through the interface and that the presence of RF fields in the bottom of the funnel effect ion transmission through the ion funnel device.

To accomplish effective capture of the expanding ion plume, the exit of the heated capillary was positioned so as to be both flush with the opening of the first electrode and aligned with the central axis of the funnel. This choice was based in part on results that indicated maximum ion currents (58 $\mu$M ubiquitin solution) detected when the heated capillary was flush with the opening of the first electrode. Secondly, the heated capillary inlet was maintained at a higher relative potential to that of electrode #1, thus ensuring the ions movement into the entrance of the ion funnel. For example, for positive ions, with the initial potential of the DC gradient on electrode #1 set at 300 V, ion transmission (same ubiquitin solution) was consistent for a heated capillary inlet potential in the 300–500 V range. However, if the capillary potential was lowered to 200 V then the observed transmission in ion current decreased to approximately 70% of the values observed for a capillary voltage in the 300–500 V range. The latter observation corresponds to a fraction of the ions electrostatically rejected from entering the funnel.

Ion currents were also measured as a function of concentration for ubiquitin solutions ranging from 0.58 to 58 M (FIG. 7, data sets A, D, and E respectively). The detected current increased (although not linearly) with the concentration of the analyte. This indicates that the majority of the detected ion current for higher concentrations are lower m/z related and not solvent related ions and/or charged droplets.

Figure 8A:
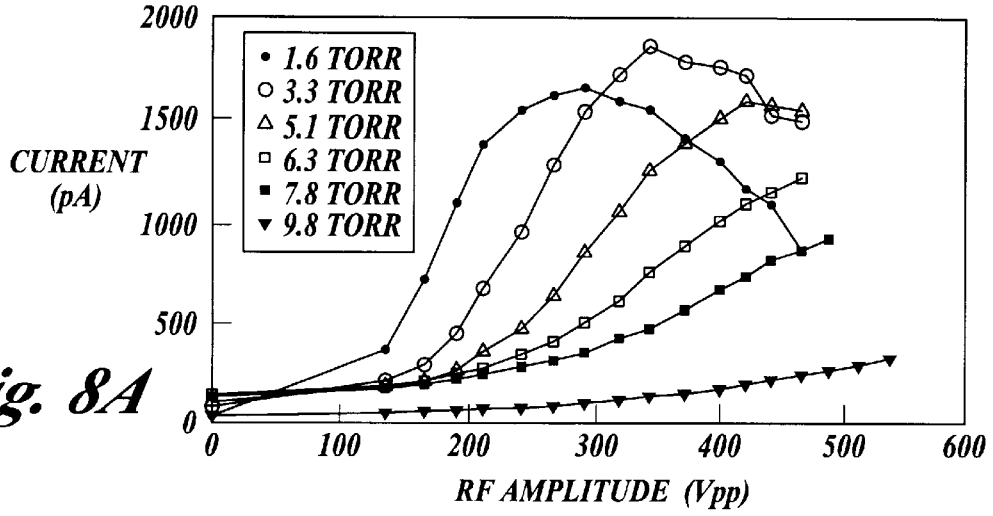
FIG. 8A is the ion current measured on the final oriface electrode in the third prototype of the present invention using 98 $V_{pp}$ RF (825 kHz) on electrodes #1–25 and 78 $V_{pp}$ on electrodes #26–28 from a 58 M bovine ubiquitin solution using a 510 micrometer i.d. capillary inlet with first stage pumping in the ion funnel regulated to six selected pressures and capillary inlet temperature at 170° C.
Figure 8B:
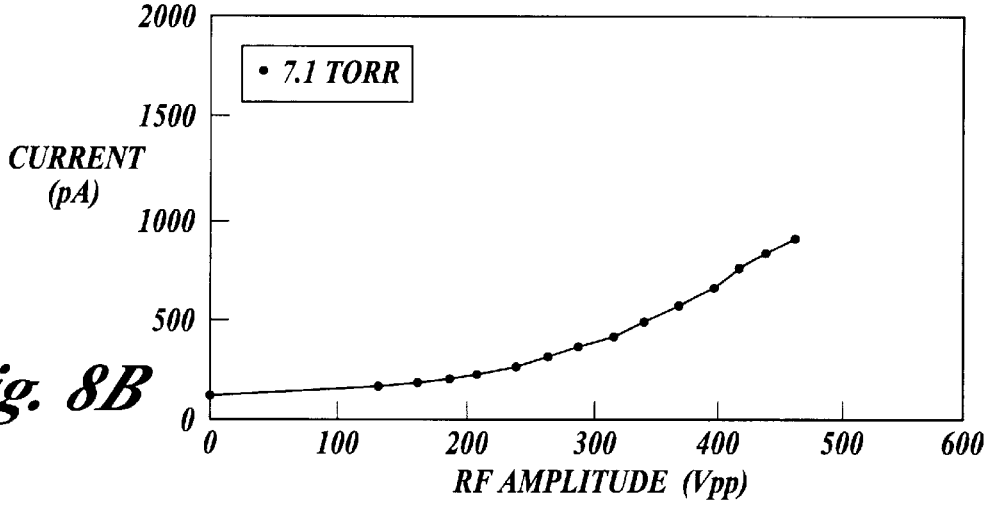
FIG. 8B is the ion current measured on the final oriface electrode in the third prototype of the present invention using 98 $V_{pp}$ RF (825 kHz) on electrodes #1–25 and 78 $V_{pp}$ on electrodes #26–28 from a 58 M bovine ubiquitin solution using a 760 micrometer i.d. capillary inlet at 7.1 Torr and capillary inlet temperature at 170° C.

The effects of pressure were explored by partially closing a valve located in between the ion funnel and the first stage mechanical pump. As the pressure in the ion funnel was raised, a higher RF amplitude was required to achieve similar ion transmission than when measured at lower relative pressure as shown in FIG. 8A. For the 1–10 Torr range, as measured using the convection gauge, maximum ion currents were achieved for the 1–5 Torr range but above this the required RF amplitude needed to maximize ion transmission was above the RF breakdown threshold (i.e. 400–500 $V_{pp}$) of the ion funnel. Increasing the size of the capillary inlet from 510 to 760 micrometer inner diameter accommodated more ions, as evidenced by the higher ion current for the DC-only mode for the 760 micrometer i.d. capillary inlet as shown in FIG. 8B. However, the larger capillary consequently resulted in a higher operating pressure (7.1 Torr) and thus resulted in a larger RF requirement to focus the available ions. Note that the appearance of this curve is similar to the curve measured at 7.8 Torr with the 510 micrometer i.d. capillary. Therefore, there exists a useful operating pressure range for the ion funnel operating at a given RF frequency and this operating range in practice is determined on the low end by the size of the inlet capillary and the pumping speed applied to the ion funnel region and on the high end by the RF breakdown threshold for the ion funnel.

Figure 8C:
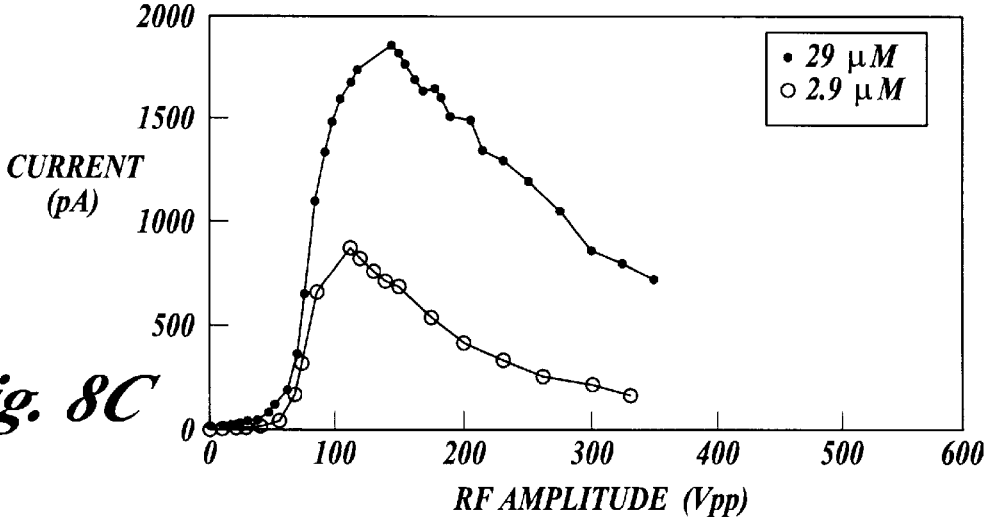
FIG. 8C is the ion current measured on the octapole ion guide electrode in the third prototype of the present invention using 98 $V_{pp}$ RF (700 kHz) on all electrodes for a horse heart myoglobin solution with a concentration of 29 and 2.9 M and capillary inlet temperature at 215° C.

Ion current transmitted to the octapole ion guide was measured using aluminum foil covering its entrance. The ion currents detected for 29 and a 2.9 M solutions of horse heart myoglobin for the 0–350 $V_{pp}$RF amplitude range are shown in FIG. 8C Similar to the results obtained with ubiquitin, the maximum ion current displays a 2 order of magnitude increase compared to the ion funnel operating in the DC-only mode. An important figure of merit for the ion funnel is the fraction of total current entering the interface that is effectively transmitted. The ion current entering the vacuum chamber and directed towards the entrance to the ion funnel was measured using a plate at ground immediately following the exit of the capillary inlet (~5 mm). Table 2 gives the currents measured for myoglobin, cytochrome c, and gramicidin S solutions.

TABLE 2

Ion Current Measured on Octapole Ion Guide Using the: Standard Ion Source (A), Ion Funnel (B)*; Ion Current Measured Entering the Ion Funnel (C), Ratio of B/A and Ratio B/C (×100).

| | A | B | C | B/A | B/C (×100) |
|---|---|---|---|---|---|
| Myoglobin | | | | | |
| 29 M | 77 pA | 1.5 nA | 6.0 nA | 19 | 25% |
| 2.9 M | 18 pA | .75 nA | 3.2 nA | 42 | 23% |
| Cytochrome c | | | | | |
| 40 M | 57 pA | 1.4 nA | 5.8 nA | 25 | 24% |
| 4.0 M | 20 pA | .84 nA | 4.0 nA | 42 | 21% |
| Gramicidin S | | | | | |
| 3.0 M | 15 pA | .13 nA | 2.7 nA | 9 | 5% |

*Measured at 700 kHz with 98 $V_{pp}$ except gramicidin S which used 75 $V_{pp}$.

These values allow a low end transmission estimate for the ion funnel of approximately 21–25% for the proteins. The actual transmission of the ion funnel is certainly higher since the current includes both low m/z (solvent related) and high m/z droplet components. The low m/z ions will not be transmitted (due to instabilities in the applied RF fields) while the high m/z ions will not be focused at the applied RF amplitude and will be transmitted with very low efficiency. Thus, the overall efficiency of protein ion transmission through the ion funnel for the analytically significant portions of the ion current transmitted through the capillary inlet is likely 50% or greater. The transmission efficiency for the peptide, however, is lower by a factor of ~5. This stems from the fact that there is a low m/z cut-off for the ion funnel, i.e. a low mass limit to which ions are not efficiently transmitted through the interface.

Ion current transmitted to the octapole ion guide was also taken for the standard Finnigan ESI ion source for selected concentrations of myoglobin, cytochrome c, and gramicidin S (Table 2).

The ratio of the ion current measured with the ion funnel over the ion current measured with the standard ESI ion source can be used to estimate the effectiveness or overall sensitivity gain using the present ion funnel design. For the proteins studied, the ratios indicate that the ion funnel delivers a 20 to 40 times greater ion current to the octapole ion guide (and eventually the mass analyzer) than the standard ESI ion source. The peptide gave a ratio of 9 times the ion current over that of the standard ESI ion source.

Figure 9A:
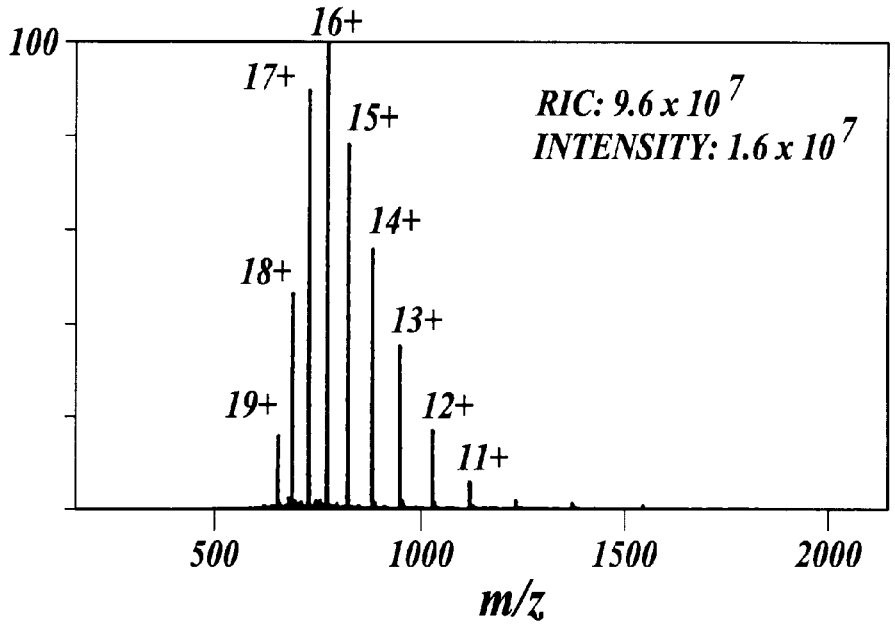
FIG. 9A is a mass spectra of a 4.0 M horse heart cytochrome c solution taken from the third prototype of the present invention.
Figure 9B:
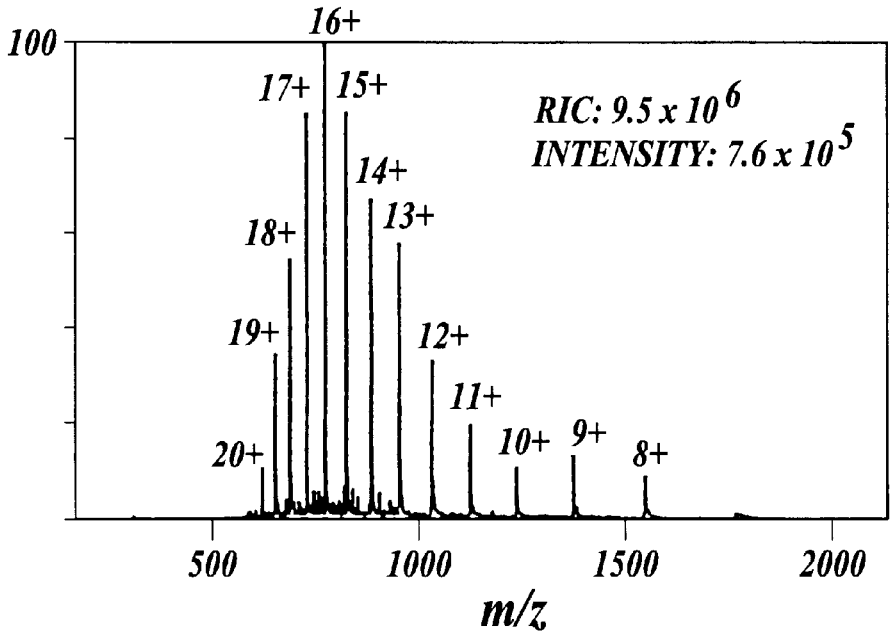
FIG. 9B is a mass spectra of a 4.0 M horse heart cytochrome c solution taken the standard ESI ion source.

Mass Spectra. Mass spectra for selected protein and peptide solutions were acquired with the prototype ion funnel mounted directly in front of the octapole ion guide using a Finnigan TSQ 7000 triple quadrupole mass spectrometer. The relative ion current (RIC), detected by the mass spectrometer, was then compared to the RIC obtained with the standard ESI ion source under identical multiplier and other operating conditions. An example of such a comparison for a 4.0 $\mu$M solution of horse heart cytochrome c is shown in FIGS. 9A and 9B. The spectrum obtained using the ion funnel displays 10 times the RIC and over 20 times the base peak intensity compared to the spectrum with the standard ESI source.

By interfacing the ion funnel directly to the octapole ion guide it was not necessary to use a skimmer. In fact, replacement of the skimmer by a simple conductance limiting aperture (i.e. final oriface electrode) led to a factor of 2 to 3 increase in the RIC measured for all of the protein solutions studied. Hence, in this new design, the ions are more efficiently transmitted to the octapole ion guide which enables a lower potential gradient to be used between the final oriface electrode and octapole ion guide. This characteristic is generally desirable since it minimizes the likelihood of undesired collisional activation in this region, which may induce dissociation or preclude detection of non-covalent complexes.

Ratios of relative ion current were derived from mass spectra for solutions of myoglobin, cytochrome c, and gramicidin S (Table 3).

TABLE 3

Ratio of Relative Ion Current (RIC) Obtained from Mass Spectra Measured with the Ion Funnel Prototype Divided by that Measured with the Standard Ion Source.*

| | Ratio |
|---|---|
| 29 M Myoglobin | 12 |
| 2.9 M Myoglobin | 12 |
| 40 M Cytochrome c | 12 |
| 4.0 M Cytochrome c | 14 |
| 3.0 M Gramicidin S | 3 |

*Ion funnel operated at 700 kHz (98 $V_{pp}$, except for gramicidin S which used 75 $V_{pp}$). Ratios based on RIC for the proteins and peak intensity for the 2+ charge state (m/z 572) for gramicidin S.

When comparing the RIC measured using the ion funnel to the standard ESI ion source, the ion funnel yielded a 12–14 times improvement over the standard ESI ion source for the proteins. The measurements for the standard ion source were obtained with three different inlet capillaries, all equivalent in dimensions but which differed in performance. For this reason the results for the least sensitive capillary were dropped while the results for the two most sensitive capillaries were averaged, the latter being in good agreement. The RIC ratios derived from the mass spectra are more consistent and are significantly lower than the ratios derived from ion current measured on the octapole given in Table 2. The higher ratios derived from ion current measurements on the octapole can be potentially attributed to a fraction of charged droplets that are carried by vacuum dynamics from the ion funnel to the entrance of the octapole but are unable to travel through the triple quadrupole mass analyzer since the TSQ 7000 employs a non-linear configuration. Furthermore, the standard TSQ 7000 ion source employs an off-axis capillary inlet, i.e. the exit of the capillary is off-axis relative to the entrance of the skimmer cone, which was specifically designed to eliminate solvent spiking of the mass analyzer.

Figure 9C:
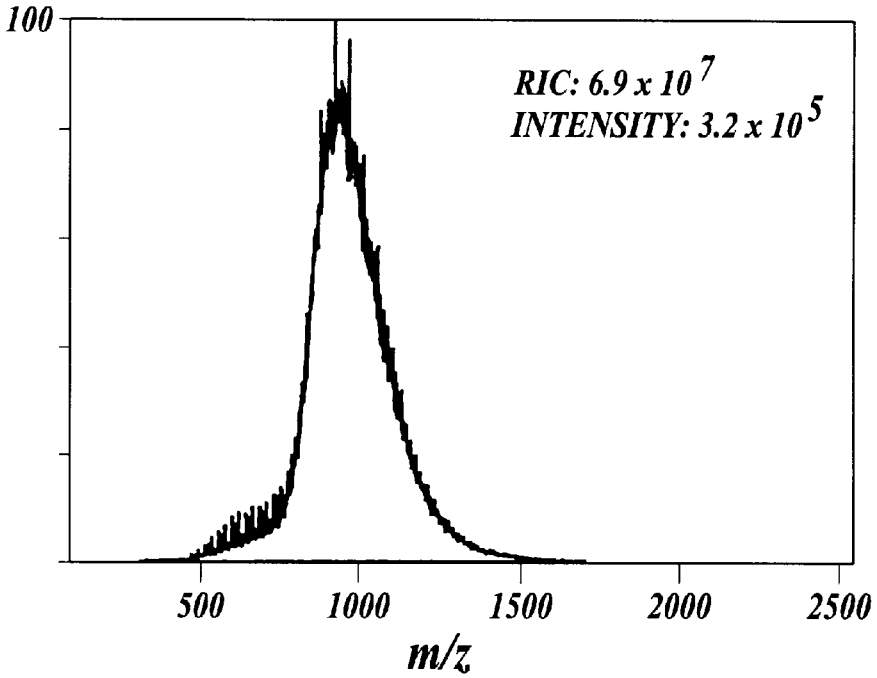
FIG. 9C is a mass spectra of a 0.25 mg/ml polyethylene glycol (average MW=8000) solution taken with the from the third prototype of the present invention and capillary inlet temperature at 200° C.
Figure 9D:
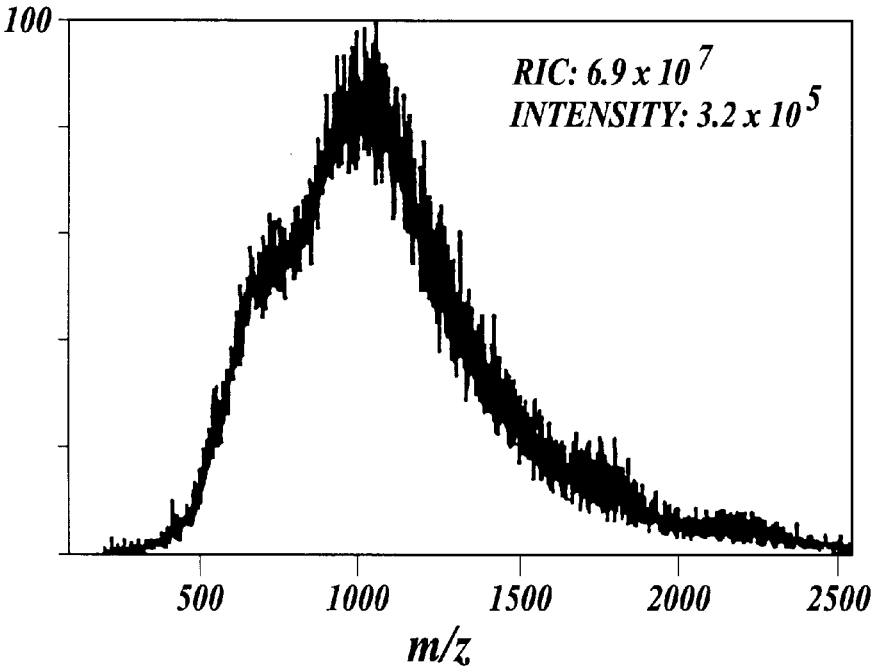
FIG. 9D is a mass spectra of a 0.25 mg/ml polyethylene glycol (average MW=8000) solution taken with the standard ESI ion source and capillary inlet temperature at 200° C.

The result in Table 3 for gramicidin S display a gain of 3 times the peak intensity based on its $2^+$ charge state, the dominant ion in its spectrum under acidic conditions. This observation is in line with the low mass cutoff of the prototype interface i.e. a lower limit in m/z for which ions are not efficiently transmitted through the device. Work with other singularly charged peptides indicates a nominal cutoff at approximately m/z 500 for the present design and operating conditions. This cutoff and indeed the entire transmission window can be illustrated by comparing the spectrum of polyethylene glycol (average molecular weight, 8000 amu) obtained with both ESI interfaces as shown in FIGS. 9C and 9D. The spectrum taken with the ion funnel yields a transmission window of ~2 (i.e. high m/z low m/z) or less than 1000 m/z units at the RF amplitude employed used for these examples.

Figures 10A, 10B, 10C, 10D, 10E, 10F, 10G, 10H:
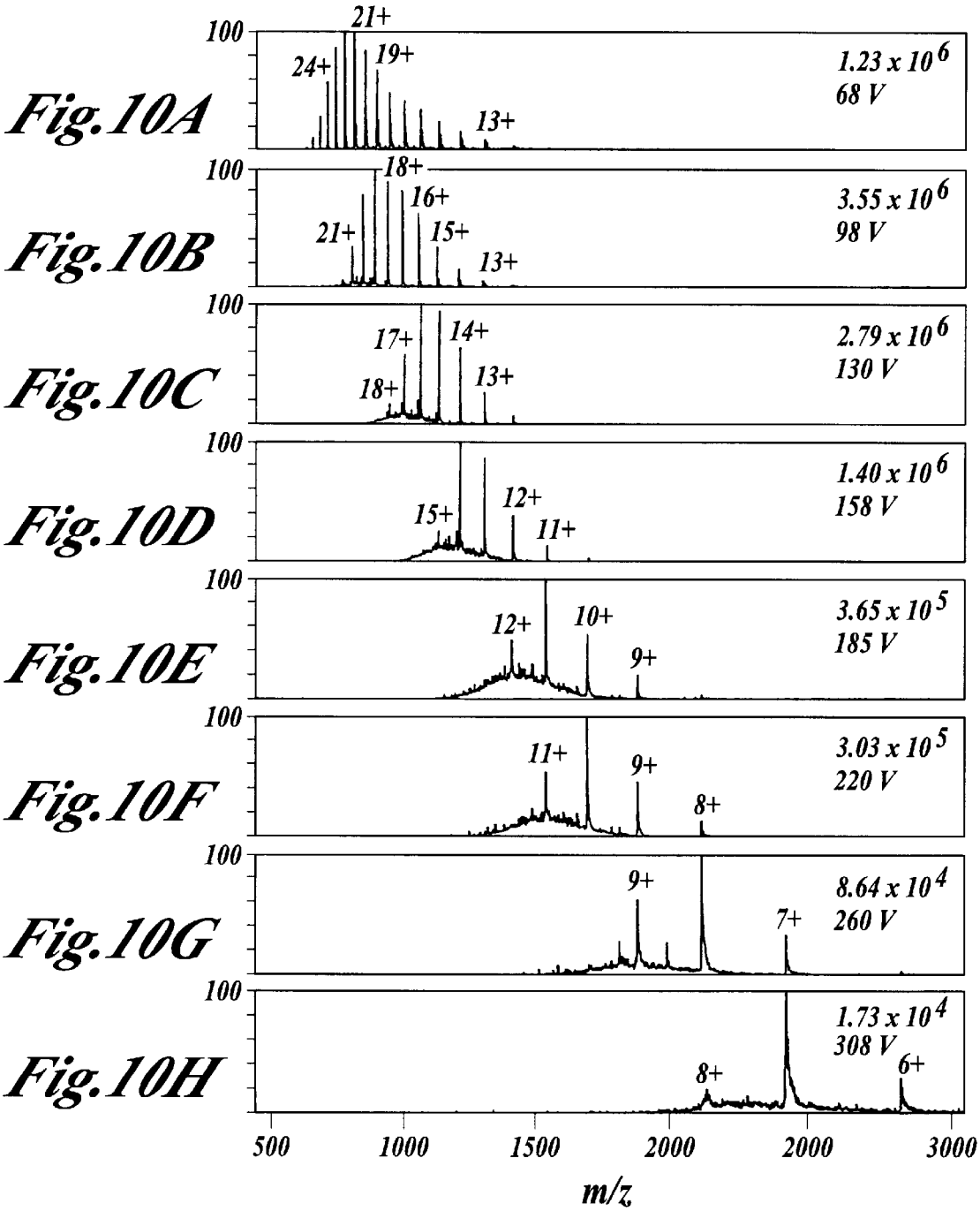
FIG. 10 is a series of mass spectra of a 29 M horse heart myoglobin solution acquired from the third prototype of the present invention operating with an RF amplitude (700 kHz) of: (A) 68 $V_{pp}$; (B) 98 $V_{pp}$; (C) 130 $V_{pp}$; (D) 158 $V_{pp}$; (E) 185 $V_{pp}$; (F) 220 $V_{pp}$; (G) 260 $V_{pp}$; (H) 308 $V_{pp}$ with the base peak intensity is given in the upper right corner and capillary inlet temperature at 215° C.
Figure 11:
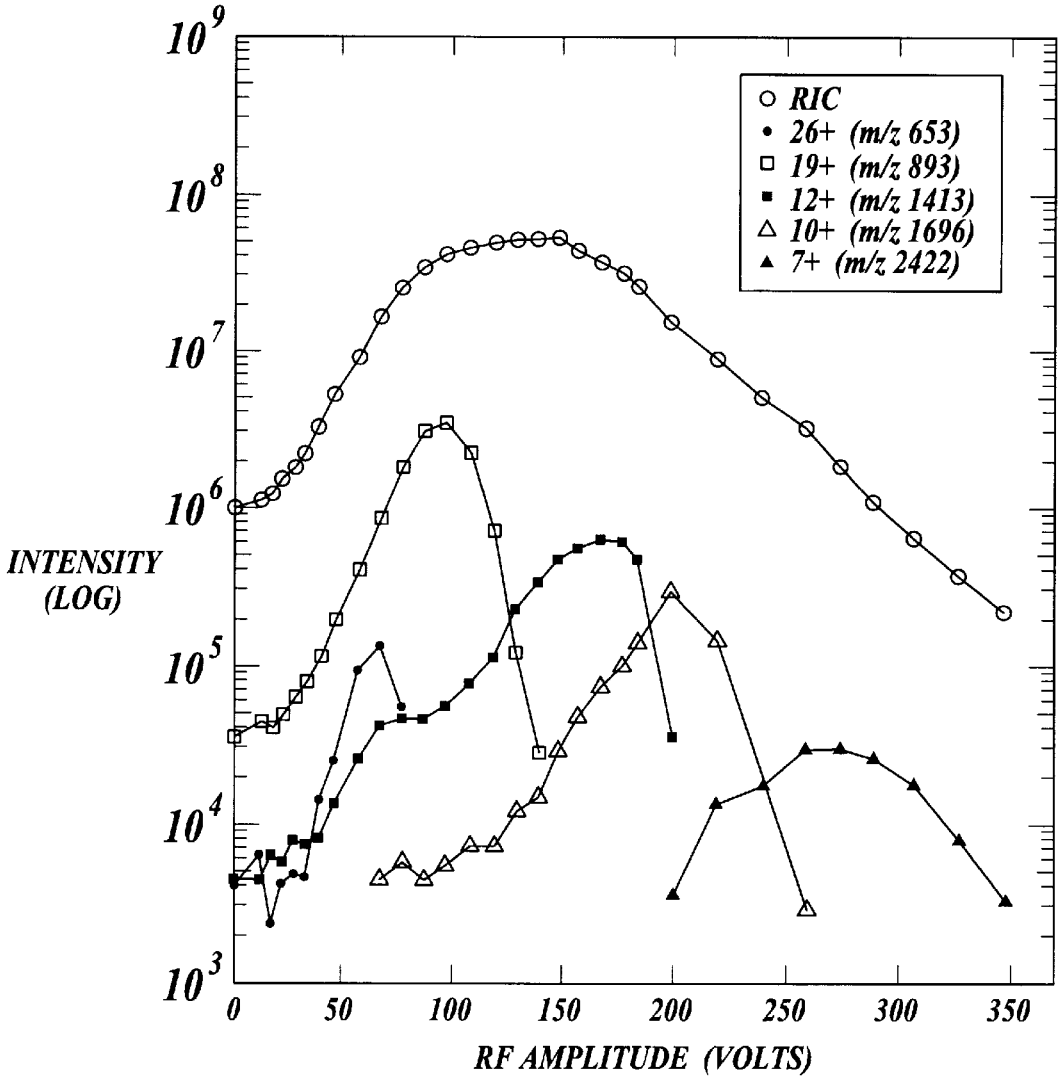
FIG. 11 is a log plot of relative ion current (RIC) and selected charge state intensities as a function of ion funnel RF amplitude (700 kHz) from mass spectra for a 29 M horse heart myoglobin solution from the third prototype of the present invention and capillary inlet temperature at 215° C.

As expected, the RF amplitude has a direct effect on the m/z cutoff of the interface and the transmission window. This effect is illustrated with mass spectra obtained using a 29 M solution of horse heart myoglobin as shown in FIG. 10. At first, as the RF amplitude is increased, the signal intensity for all of the charge states (i.e. $26^+$–$12^+$) increase until the ions of low m/z (i.e. the high charge states) are unstable by the imposed RF fields and are therefore unable to be transmitted through the ion funnel. Continuing to increase the RF amplitude increasingly shifts the low m/z cut-off to higher m/z values. As the low m/z ions are lost, the higher m/z ions are more effectively focused through the ion funnel. This effect is shown in FIG. 11 which plots the relative ion current (RIC) and selected peak intensities of individual charge states for the same myoglobin solution. The $19^+$ charge state (m/z 893.1), typically the base peak in the ESI mass spectrum for denatured myoglobin obtained with a conventional ion source, is the base peak in the spectrum for an RF amplitude of up to ~100 $V_{pp}$ after which its intensity is sharply reduced due to its instability in the higher RF fields. As the RF amplitude is increased the lower charge states (e.g. $12^+$, $10^+$, and $7^+$ shown) sequentially increase in relative abundance. The expected linear relationship is evident by plotting m/z versus the RF amplitude needed to maximize the peak intensity for a given charge state as shown in FIG. 12A.

Increasing the RF amplitude increased the RIC of the myoglobin spectra to 150 $V_{pp}$ where the overall RIC begins to decline as shown in FIG. 11. Operating the ion funnel at 150 $V_{pp}$RF (700 kHz) resulted in an increase in RIC by over 50 times compared to the ion funnel operating in the DC-only mode. Operation at fixed RF amplitude yielded similar spectra (in terms of ion m/z) that increased in signal intensity until about 70 $V_{pp}$ after which the low m/z cutoff begins to effect the spectrum by progressively removing the highest charge state on the lower m/z end of the spectrum. Since the effect of RF amplitude on the low m/z cutoff is linear with m/z, this bias can be used to reduce space charge limits (and improve ion focusing through a conductance aperture) and/or remove low m/z species from contributing to the capacity of ion trapping instruments.

Figure 12B:
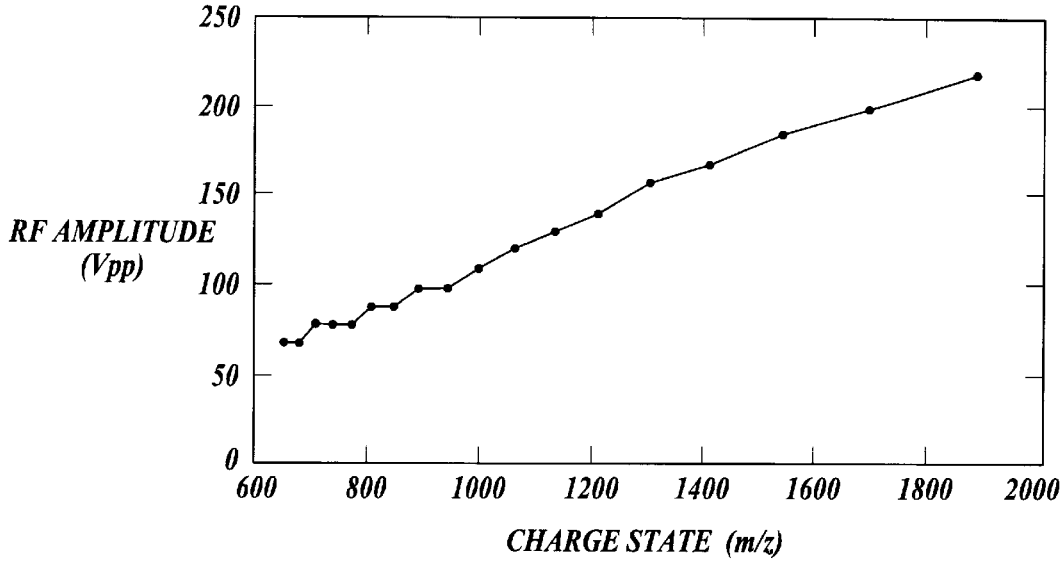
FIG. 12B is a plot of maximum charge state intensities (recorded at multiple RF amplitudes) using the third prototype of the present invention versus the charge state intensities using the standard ESI source for a 29 M horse heart myoglobin solution.
Figure 12B:
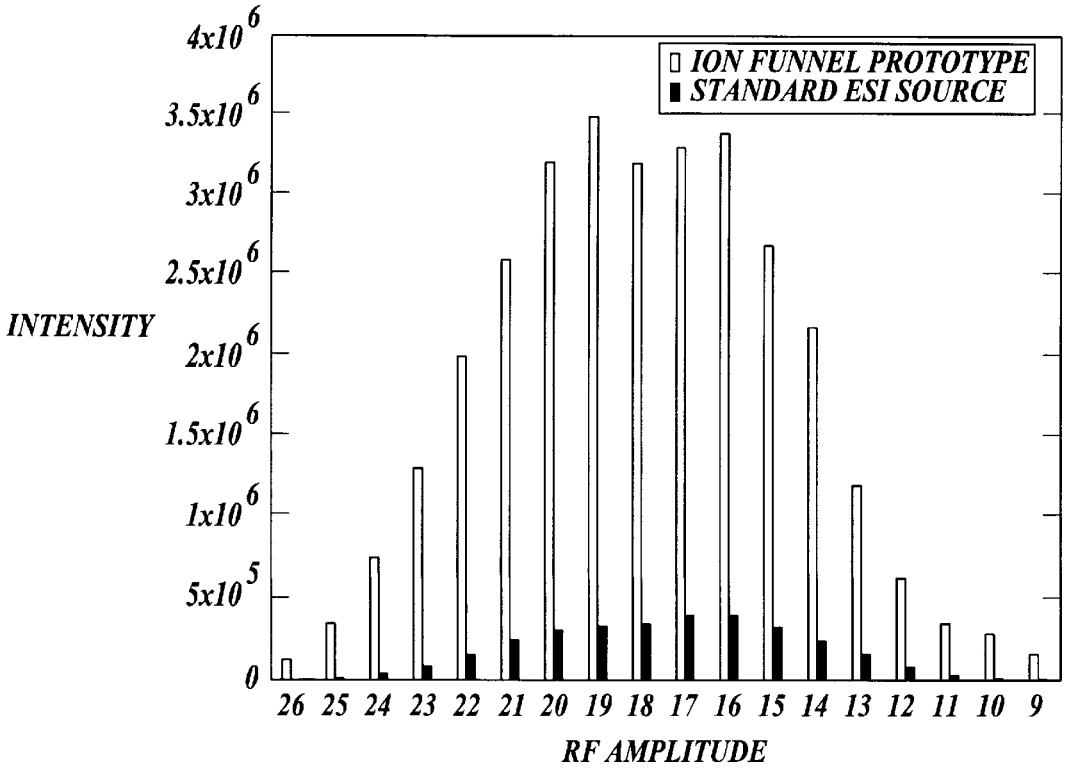

As shown in FIG. 10, at RF levels above 100 $V_{pp}$, there are a multitude of peaks that appear in the region of the low m/z cut-off. These are products of collisional induced dissociation (CID) and originate from increased translational energy of low m/z ions near their stability limit in the ion funnel at the given RF amplitude. Contributions from CID can be effectively minimized by scanning the RF amplitude in-link with the m/z scan of the quadrupole mass analyzer. This method of scanning would also bring in the maximum intensity for all of the charge states produced by the ESI process. This advantage is illustrated by plotting the maximum peak intensities of the given myoglobin charge states and comparing them to the charge state intensities obtained with most sensitive capillary inlet used on the standard ESI ion source as shown in FIG. 12B. A secondary benefit is that moderate amounts of collisional activation can be produced in the ion funnel to reduce contributions due to charge state adduction. Note that in FIG. 10 adducts associated with lower charge states are reduced as the RF level is increased.

While a preferred embodiment of the present invention has been shown and described, it will be apparent to those skilled in the art that many variations, changes and modifications may be made without departing from the invention in its broader aspects. The appended claims are therefore intended to cover all such changes and modifications as fall within the true spirit and scope of the invention.

We claim:

1. A method of focusing dispersed charged particles comprising the steps of:

a) providing a plurality of elements in a region maintained at a pressure between $10^{-1}$ millibar and 1 bar, each of said elements having successively larger apertures wherein said apertures form an ion funnel having an entry at the largest aperture and an exit at the smallest aperture, b) applying an RF voltage to each of the elements wherein the RF voltage applied to each element is out of phase with the RF voltage applied to the adjacent element(s), c) directing charged particles into the entry and out of the exit of the ion funnel, thereby focusing the charged particles.

2. The method of claim 1 further comprising the step of directing the charged particles is provided by a mechanical means.

3. The method of claim 2 wherein the mechanical means is selected from the group comprising a fan, a vacuum, or combinations thereof.

4. The method of claim 1 further comprising the step of directing the charged particles by providing a DC potential gradient across the plurality of elements.

5. The method of claim 1 further comprising the step of directing charged particles generated in a multi-inlet system into the ion funnel.

6. The method of claim 1 further comprising the step of providing a plurality of said ion funnels in series.

7. The method of claim 1 wherein the exit of said ion funnel is provided adjacent to a multipole lens element.

8. The method of claim 1 wherein the exit of said ion funnel is provided adjacent to a quadrupole lens element.

9. An apparatus for focusing dispersed charged particles comprising:

a) a plurality of elements contained within a region maintained at a pressure between $10^{-1}$ millibar and 1 bar, each of said elements having progressively larger apertures wherein said apertures form an ion funnel having an entry at the largest aperture and an exit at the smallest aperture and an RF voltage applied to each of the elements wherein the RF voltage applied to each element is out of phase with the RF voltage applied to the adjacent element(s).

10. The apparatus of claim 9 further comprising a mechanical means for directing charged particles through the ion funnel.

11. The apparatus of claim 10 wherein the mechanical means is selected from the group comprising a fan and a vacuum, or combinations thereof.

12. The apparatus of claim 9 further comprising a DC potential gradient across the plurality of elements.

13. The apparatus of claim 9 wherein the shape of said apertures are selected from the group comprising circular, oval, square, trapezoidal, and triangular.

14. The apparatus of claim 9 wherein ion funnel is incorporated to focus a dispersion of charged particles in a mass spectrometer.

15. The apparatus of claim 9 wherein ion funnel is incorporated to focus a dispersion of charged particles in an ion mobility analyzer.

16. The apparatus of claim 9 wherein ion funnel is incorporated to focus a dispersion of charged particles generated in a multi-inlet system.

17. The apparatus of claim 9 wherein the exit of said ion funnel is provided adjacent to a multipole lens element.

18. The apparatus of claim 9 wherein the exit of said ion funnel is provided adjacent to a quadrupole lens element.

19. A method of trapping charged particles comprising the steps of:

a) providing a plurality of elements within a region maintained at a pressure between $10^{-1}$ millibar and 1 bar, each of said elements having successively larger apertures wherein said apertures form an ion funnel having an entry at the largest aperture and an exit at the smallest aperture, b) applying an RF voltage to each of the elements wherein the RF voltage applied to each element is out of phase with the RF voltage applied to the adjacent element(s), c) providing a DC voltage at the exit of said ion funnel sufficient to capture said charged particles, and d) directing a volume of gas containing said charged particles into the entry of said ion funnel, thereby capturing said charged particles in said ion funnel.

20. The method of claim 19 further comprising the step of reducing the DC voltage applied to the exit of said ion funnel, thereby releasing said charged particles captured in said ion funnel.

21. The method of claim 19 further comprising the steps of:

a) providing said ion funnel at an aperture separating two regions maintained at different pressures, said aperture being covered by a gate, b) reducing the DC voltage applied to the exit of said ion funnel while simultaneously opening said gate, thereby releasing said charged particles captured in said ion funnel and directing said ions through said aperture.

22. The method of claim 19 wherein said volume of gas is drawn from the atmosphere and said charged particles are ambient ions found in the atmosphere.

23. An apparatus for focusing dispersed charged particles comprising:

a) two elements within a region maintained at a pressure between $10^{-1}$ millibar and 1 bar, placed adjacent to each other, each of said elements formed into a conical coil, said coils forming an ion funnel having an entry at the largest end and an exit at the smallest end, wherein an RF voltage is applied to each of the elements and said RF voltage applied to each element is 180 degrees out of phase with the RF voltage applied to the adjacent element.

* * * * *